US007199511B2

(12) United States Patent
Hori

(10) Patent No.: US 7,199,511 B2
(45) Date of Patent: Apr. 3, 2007

(54) SPARK PLUG WITH NOBLE METAL CHIP JOINED BY UNIQUE LASER WELDING AND FABRICATION METHOD THEREOF

(75) Inventor: Tsunenobu Hori, Kariya (JP)

(73) Assignee: DENSO Corporation (JP)

( * ) Notice: Subject to any disclaimer, the term of this patent is extended or adjusted under 35 U.S.C. 154(b) by 216 days.

(21) Appl. No.: 10/901,042

(22) Filed: Jul. 29, 2004

(65) Prior Publication Data

US 2005/0023949 A1 Feb. 3, 2005

(30) Foreign Application Priority Data

Jul. 30, 2003 (JP) ..... 2003-282873

(51) Int. Cl.
*H01T 13/20* (2006.01)

(52) U.S. Cl. ..... 313/143; 313/118

(58) Field of Classification Search ..... 445/7; 313/143

See application file for complete search history.

(56) References Cited

U.S. PATENT DOCUMENTS

2002/0092835 A1 7/2002 Uchara
2002/0105254 A1 8/2002 Hori

FOREIGN PATENT DOCUMENTS

| | | |
|---|---|---|
| EP | 1168542 A1 | 1/2002 |
| JP | 2001-135456 | 5/2001 |
| JP | 2001-237365 | 8/2002 |

OTHER PUBLICATIONS

French Preliminary Search Report dated Aug. 8, 2006.

*Primary Examiner*—Joseph Williams
*Assistant Examiner*—Bumsuk Won
(74) *Attorney, Agent, or Firm*—Nixon & Vanderhye PC

(57) ABSTRACT

A spark plug is provided which ensures the reliability of a weld between a noble metal chip and a ground electrode as well as higher durability and ignitability of fuel. The ground electrode is joined to a metal shell, after which the noble metal chip is laser-welded to the ground electrode. The laser welding is achieved by emitting laser beams around an interface between the noble metal chip and the ground electrode outside a given angular range within which the metal shell will be an obstruction to the traveling of the laser beams. Specifically, the laser beams are emitted without any optical interference with the metal shell. This permits the angle between the orientation of each of the laser beams and the surface of the ground electrode to be minimized regardless of the metal shell, thus ensuring a desired depth of the fused portions in the noble metal chip.

7 Claims, 24 Drawing Sheets

SPARK PLUG WITH NOBLE METAL CHIP JOINED BY UNIQUE LASER WELDING AND FABRICATION METHOD THEREOF

BACKGROUND OF THE INVENTION

1. Technical Field of the Invention

The present invention relates generally to a spark plug which may be employed in automotive engines, and more particularly to such a spark plug with noble metal chips joined to a center and a ground electrode by unique laser welding for ensuring higher durability of the spark plug and ignitability of a gaseous fuel and a fabrication method therefor.

2. Background Art

Typical spark plugs for automotive engines or gas engines are equipped with a center electrode and a ground electrode. The center electrode is disposed within a metal shell and has a tip exposed outside the metal shell. The ground electrode is joined at one end thereof to the metal shell and bent to have the other end thereof face the center electrode through a spark gap.

Recently, in order to improve the durability of the spark plugs and ignitability of fuel, noble metal chips made of Pt (Platinum) or Ir (Iridium) have been used which are laser-welded to surfaces of the center and ground electrodes opposed to each other through the spark gap.

Japanese Patent First Publication No. 2001-135456 teaches conventional laser welding to joint the noble metal chips to the center and ground electrodes. The laser welding is achieved by emitting laser beams around entire circumferences of interfaces between the noble metal chips and the center and ground electrodes at orientations which do not optically interfere with the metal shell.

The above laser welding will be described below in detail with reference to FIG. 27.

A noble metal chip 45 is welded to a ground electrode 40. The ground electrode 40 is welded at an end thereof to a metal shell (not shown).

The weld of the noble metal chip 45 to the ground electrode 40 is achieved by emitting laser beams LZ around an interface between the noble metal chip 45 and a side surface 43 of the ground electrode 40 to form fused portions 44 (also called weld nuggets).

In the drawing, θL represents the angle between the side surface 43 and orientation of radiation of each of the laser beams LZ (will also be referred to as a radiation angle below) In the following discussion, LZ will also represents a laser radiation path along which the laser beams LZ are radiated.

The radiation of the laser beams LZ is performed after the ground electrode 40 is welded to the metal shell, but before bent.

In a case where the metal chip is located on the left side of the noble metal chip 45, as viewed in the drawing, elimination of interference of the laser beams LZ with the metal shell requires increasing the radiation angle θL which causes the laser beams LZ to travel beyond the metal shell toward the side surface 43. The increased radiation angle θL, however, will result in a decrease in depth DW of a portion of the noble metal chip 45 which is fused by the laser beam LZ into the ground electrode 40 in a radius direction of the noble metal chip 45, thus leading to an undesirable increase in unfused area in the interface between the noble metal chip 45 and the ground electrode 40.

In modern engines, a combustible atmosphere is elevated in temperature for increasing an output power and reducing a fuel consumption and exhaust emissions. In this type of engine, a park plug is subjected to an intense heat, so that the temperature of center and ground electrodes is increased greatly. The electrodes, therefore, undergo a thermal stress and oxidation, which may cause the noble metal chips to be removed from the center and ground electrodes. Particularly, such a problem is exacerbated in the ground electrode because it is exposed to a combustion chamber of the engine more than the center electrode.

The noble metal chip 45 of the spark plug, as disclosed in the above publication, has a relatively shorter length t projecting from the side surface 43. A decrease in the length t may cause the fused portion 44 to reach a spark discharging surface 45*a*, thus causing the fused portions 44 to be worn earlier than the noble metal chip 45, which, in the worst case, results in separation of the noble metal chip 45 from the ground electrode 40.

In order to avoid the above problem, US2002/01105254 A1 teaches laser welding techniques of decreasing the radiation angle θL to increase the melted depth DW of the noble metal chip 45. Specifically, the radiation angle θL is decreased to set a melt angle less than 60°. The melt angle is the angle which a line extending through the fused portion 44 along a maximum depth of the fused portion 44 makes with the side surface 43 of the ground electrode 40. This results in a decrease in size of an unfused portion in the interface between the noble metal chip 45 and the ground electrode 40, thereby ensuring the reliability of a joint between the noble metal chip 45 and the ground electrode 40 in a high temperature combustible atmosphere.

The laser welding, as taught in the latter publication, has the drawback in that the metal shell will be an obstruction to the traveling of the laser beams, thus resulting in a difficulty in welding the entire circumference of the interface between the noble metal chip 45 and the ground electrode 40. The spark plug is, thus, assembled in a manner wherein the noble metal chip 45 is welded to the side surface 43 of the ground electrode 40, after which the ground electrode 40 is welded to the metal shell. Such assembling process, however, results in decreased productivity of the spark plug. Specifically, the noble metal chip 45 installed on the ground electrode 40 obstructs the welding of the ground electrode 40 to the metal shell, which will lead to an increase in production cost of the spark plug. In the worst case, when the ground electrode 40 is chucked, the noble metal chip 45 may be broken.

SUMMARY OF THE INVENTION

It is therefore a principal object of the invention to avoid the disadvantages of the prior art.

It is another object of the invention to provide a structure of a spark plug designed to improve the reliability of a weld of a noble metal chip to a ground electrode without sacrificing the productivity of the spark plug and also provide a fabrication method thereof.

According to one aspect of the invention, there is provided a higher durability and productivity spark plug which may be employed in automotive engines. The spark plug comprises: (a) a metal shell; (b) a center electrode disposed within the metal shell with a top portion thereof projecting from the metal shell, the center electrode having a noble metal chip laser-welded to the top portion; (c) a ground electrode having a first end portion, a second end portion, and a middle portion between the first and second end portions, the first end portion being welded to the metal shell, the second end portion having a center electrode-opposed surface on which a noble metal chip is laser-welded, the middle portion being bent to have the noble metal chip face the noble metal chip of the center electrode through a spark gap; and (d) fused portions formed around an interface between the noble metal chip and the center electrode-opposed surface of the ground electrode. The fused portions create welds between the noble metal chip and the ground electrode and are formed by materials of the ground electrode and the noble metal chip melted together by emitting laser beams around the interface between the noble metal chip and the center electrode-opposed surface of the ground electrode.

The noble metal chip of the ground electrode has a given length and projects toward the center electrode from the center electrode-opposed surface by 0.3 mm or more in a longitudinal direction thereof, If a line extending inward of the noble metal chip of the ground electrode through a center of a sectional area of each of the fused portions, as taken over the interface between the noble metal chip and the center electrode-opposed surface of the ground electrode, is defined as a fused portion sectional area center line, and an angle which lines extending from the noble metal chip on the ground electrode before bent to edges of the metal shell opposed in a widthwise direction of the metal shell, as defined on a plane expanding over the center electrode-opposed surface of the ground electrode, makes with each other is defined as θ1, the fused portion sectional area center lines lying outside the angle θ1.

If a transverse sectional area of a portion of the noble metal chip of the ground electrode closest to the fused portions, as taken perpendicular to the length of the noble metal chip of the ground electrode, is defined as A, and a transverse sectional area of a unfused portion of the noble metal chip of the ground electrode, as taken over the interface between the noble metal chip and the center electrode-opposed surface of the ground electrode is defined as B, an unfused portion sectional area percentage that is a percentage of the sectional area B in the sectional area A is 50% or less.

The angle θ1 represents a range within which the metal shell will be an obstruction to the traveling of the laser beams after the ground electrode is installed on the metal shell, but before the ground electrode is bent. The laser beams are emitted outside the angle θ1 without any optical interference with the metal shell. This permits the angle between the orientation of each of the laser beams and the center electrode-opposed surface to be minimized regardless of the metal shell, thus ensuring a desired depth of the fused portions in the noble metal chip.

We have found experimentally that in a case where the noble metal chip has a length of 0.3 mm or more, the unfused portion sectional area percentage of 50% or less ensures desired reliability of the joint between the noble metal chip and the ground electrode.

In the preferred mode of the invention, an angle θ2 which two of the fused portion sectional area center lines located adjacent to each other across the angle θ1 makes with each other is greater than the angle θ1. This means that all the fused portion sectional area center lines lie outside the angle θ1.

If a line extending through a center O of a transverse sectional area of the noble metal chip of the ground electrode in parallel to a longitudinal center line of the ground electrode is defined as x, at least one of intersections of two of the fused portion sectional area center lines located adjacent to each other across the angle θ1 with the line x may be located closer to the first end portion of the ground electrode than the center O of the transverse sectional area. Specifically, the many fused portions are formed around a portion of the periphery of the noble metal chip close to the metal shell. This results in a decrease in the sectional area B of the unfused portion of the noble metal chip thereby increasing the reliability of the joint between the noble metal chip and the ground electrode.

If a greater of widths of the noble metal chip of the ground electrode in directions perpendicular to the two of the fused portion sectional area center lines located adjacent to each other across the angle θ1 is defined as D1, an interval L1 between one of the two fused portion sectional area center lines located adjacent to each other across the angle θ1 which is located closer to the first end portion of the ground electrode than the center O of the transverse sectional area and a line extending parallel to the one of the two fused portion sectional area center lines through the center O of the transverse sectional area is 0.5 times the width D1 or less. This avoids the formation of an undesirable dimple in the fused portion which arises from burning out by the laser beam. We have found that when the interval L1 is more than 0.5 times the width D1, the laser beams is emitted to a peripheral portion of the noble metal chip which is smaller in volume, so that it may melt easily and disappear, thus forming the dimple.

The noble metal chip of the center electrode is made of an Ir alloy containing 50 Wt % or more of Ir. The noble metal chip of the ground electrode is made of a Pt alloy containing 50 Wt % of Pt. The noble metal chip of the ground electrode is usually subjected to greater oxidization/volatilization-caused wear. The Pt alloy has a higher resistance to the oxidization and the volatilization and is suitable as material for the noble metal chip 45. This results in a greatly increased service life of the spark plug.

If a transverse sectional area of the noble metal chip of the center electrode, as taken in a direction perpendicular to the length thereof is defined as A1 , and a transverse sectional area of the noble metal chip of the ground electrode, as taken in a direction perpendicular to the length thereof is defined as A2, each of the sectional areas A1 and A2 is between 0.1 $mm^2$ and 1.15 $mm^2$. When the sectional areas A1 and A2 are more than 1.15 $mm^2$, it will result in a great decrease in heat transmission thereof which leads to accelerated rise in temperature of the noble metal chips. This result in excessive wear of the noble metal chips or preignition of the fuel. Conversely, when the sectional areas A1 and A2 are more than 1.15 $mm^2$, it will result in decreased ignitability of the fuel. This is because the noble metal chips cool the flame kernel during growth thereof, thus reducing the flame kernel growth.

Each of the noble metal chips of the center electrode and the ground electrode may be made of a material containing, as an additive, one of Ir, Pt, Rh, Ni, W, Pd, Ru, Os, Al, Y, and $Y_2O_3$.

It is preferable that the unfused portion sectional area percentage be 30% or less.

According to another aspect of the invention, there is provided a method of producing a spark plug including (a) a metal shell, and (b) a center electrode which is disposed within the metal shell with a top portion thereof projecting from the metal shell and has a noble metal chip laser-welded to the top portion, (c) a ground electrode having a first end portion, a second end portion, and a middle portion between the first and second end portions. The first end portion is welded to the metal shell. The second end portion has a center electrode-opposed surface on which a noble metal chip is laser-welded. The middle portion is bent to have the noble metal chip face the noble metal chip of the center electrode through a spark gap. The method comprising: welding the ground electrode to the metal shell; placing the noble metal chip on the center electrode-opposed surface of the ground electrode; radiating laser beams to an interface between the noble metal chip and the center electrode-opposed surface of the ground electrode to produce fused portions which create welds between the noble metal chip and the ground electrode and are formed by materials of the ground electrode and the noble metal chip melted together; and bending the ground electrode to have the noble metal chip face the noble metal chip on the center electrode through a spark gap.

If an angle which lines extending from the noble metal chip on the ground electrode before bent to edges of the metal shell opposed in a widthwise direction of the metal shell, as defined on a plane expanding over the center electrode-opposed surface of the ground electrode, makes with each other is defined as θ1, laser radiation paths along which the laser beams are radiated are located outside the angle θ1.

The angle θ1, as described above, represents a range within which the metal shell will be an obstruction to the traveling of the laser beams after the ground electrode is installed on the metal shell, but before the ground electrode is bent. The laser beams are emitted outside the angle θ1 without any optical interference with the metal shell. This permits the angle between the orientation of each of the laser beams and the center electrode-opposed surface to be minimized regardless of the metal shell, thus ensuring a desired depth of the fused portions in the noble metal chip.

In the preferred mode of the invention, if a line made by projecting each of the laser radiation paths onto a plane extending over the center electrode-opposed surface of the ground electrode before bent is defined as a laser path projected line, and an angle which two of the laser path projected lines located adjacent to each other across the angle θ1 make with each other is defined as θ3, the angle θ3 is greater than the angle θ1.

If a line made by projecting each of the laser radiation paths onto a plane extending over the center electrode-opposed surface of the ground electrode before bent is defined as a laser path projected line, and a line extending through a center O of a transverse sectional area of the noble metal chip of the ground electrode in parallel to a longitudinal center line of the ground electrode is defined as x, at least one of intersections of two of the laser path projected lines located adjacent to each other across the angle θ1 with the line x is located closer to the first end portion of the ground electrode than the center O of the transverse sectional area.

If a greater of widths of the noble metal chip of the ground electrode in directions perpendicular to the two of the laser path projected lines located adjacent to each other across the angle θ1 is defined as D2, an interval L2 between one of the two laser path projected lines located adjacent to each other across the angle θ1 which is located closer to the first end portion of the ground electrode than the center O of the transverse sectional area and a line extending parallel to the one of the two laser path projected lines through the center O of the transverse sectional area is 0.5 times the width D2 or less.

The noble metal chip of the center electrode may be made of an Ir alloy containing 50 Wt % or more of Ir. The noble metal chip of the ground electrode may be made of a Pt alloy containing 50 Wt % of Pt. If a transverse sectional area of the noble metal chip of the center electrode, as taken in a direction perpendicular to the length thereof is defined as A1, and a transverse sectional area of the noble metal chip of the ground electrode, as taken in a direction perpendicular to the length thereof is defined as A2, each of the sectional areas A1 and A2 is between 0.1 $mm^2$ and 1.15 $mm^2$.

Each of the noble metal chips of the center electrode and the ground electrode may be made of a material containing, as an additive, one of Ir, Pt, Rh, Ni, W, Pd, Ru, Os, Al, Y, and $Y_2O_3$.

BRIEF DESCRIPTION OF THE DRAWINGS

The present invention will be understood more fully from the detailed description given hereinbelow and from the accompanying drawings of the preferred embodiments of the invention, which, however, should not be taken to limit the invention to the specific embodiments but are for the purpose of explanation and understanding only.

In the drawings:

FIG. 3(*b*) is a plan view of FIG. 3(*a*);

FIG. 4(*b*) is a plan view of FIG. 4(*a*);

FIG. 5(*b*) is a transverse sectional view, as taken along the line A'—A' in FIG. 5(*a*);

FIG. 6(*b*) is a transverse sectional view, as taken along the line C—C in FIG. 6(*a*).

FIG. 11(*b*) is a transverse sectional view, as taken along the line E—E in FIG. 11(*a*);

FIG. 13(*b*) is a partially sectional view which shows a weld between a noble metal chip and a ground electrode in which no dimple is formed;

FIG. 14(*b*) is a plan view of FIG. 14(*a*);

FIG. 14(*c*) is a side view which shows the noble metal chip of FIG. 14(*a*) after welded to the ground electrode;

FIG. 14(*d*) is a plan view of FIG. 14(*c*);

FIG. 15(*b*) is a plan view of FIG. 15(*a*);

FIG. 15(*c*) is a side view which shows the noble metal chip of FIG. 15(*a*) after welded to the ground electrode;

FIG. 15(*d*) is a plan view of FIG. 15(*c*);

FIG. 16(*c*) is a side view which shows the noble metal chip of FIG. 16(*a*) after welded to the ground electrode;

FIG. 16(*d*) is a plan view of FIG. 16(*c*);

FIG. 17(*b*) is a plan view of FIG. 17(*a*);

FIG. 17(*c*) is a side view which shows the noble metal chip of FIG. 17(*a*) after welded to the ground electrode;

FIG. 17(*d*) is a plan view of FIG. 17(*c*);

FIG. 18(*b*) is a plan view of FIG. 18(*a*);

FIG. 18(*c*) is a side view which shows the noble metal chip of FIG. 18(*a*) after welded to the ground electrode;

FIG. 18(*d*) is a plan view of FIG. 18(*c*);

FIG. 19(*b*) is a plan view of FIG. 19(*a*);

FIG. 19(*c*) is a side view which shows the noble metal chip of FIG. 19(*a*) after welded to the ground electrode;

FIG. 19(*d*) is a plan view of FIG. 19(*c*);

FIG. 20(*b*) is a plan view of FIG. 20(*a*);

FIG. 20(*c*) is a side view which shows the noble metal chip of FIG. 20(*a*) after welded to the ground electrode;

FIG. 20(*d*) is a plan view of FIG. 20(*c*);

FIG. 22(*b*) is a top view which shows another modified form of a spark plug of the first embodiment;

FIG. 26(*b*) is a partially side illustration, as viewed from an arrow Gin FIG. 26(*a*)

DESCRIPTION OF THE PREFERRED EMBODIMENTS

Figure 1:
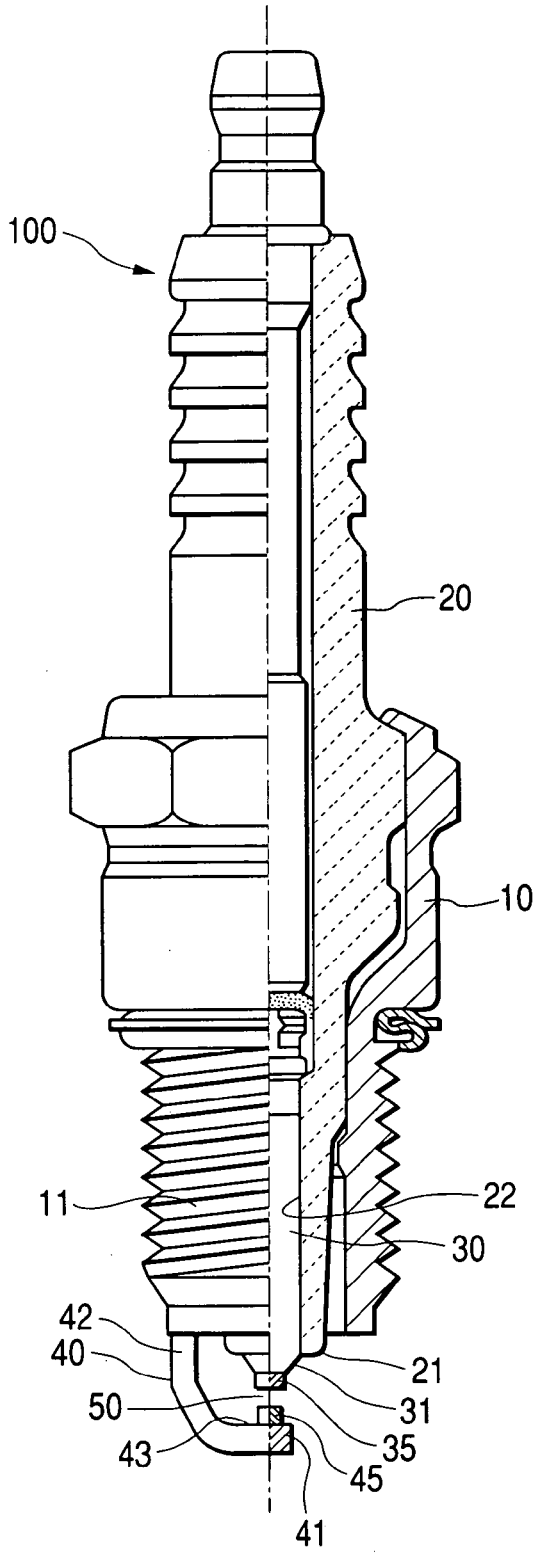
FIG. 1 is a partially sectional view which shows a spark plug according to the first embodiment of the invention.

Referring to the drawings, wherein like reference numbers refer to like parts in several views, particularly to FIG. 1, there is shown a spark plug 100 which may be used in internal combustion engines for automotive vehicles.

The spark plug 100 includes a hollow cylindrical metal shell (i.e., housing) 10, a porcelain insulator 20, a center electrode 30, and a ground electrode 40. The metal shell 10 is made of a conductive iron steel such as a low carbon steel and has cut therein a thread 11 for mounting the spark plug 100 in a plug hole of an engine head defining combustion chambers of the internal combustion engine. The porcelain insulator 20 made of an alumina ceramic ($Al_2O_3$) is retained within the metal shell 10 and has a tip 21 exposed outside the metal shell 10.

The center electrode 30 is secured in a central chamber 22 of the porcelain insulator 20 and insulated electrically from the metal shell 10. The center electrode 30 has a tip 31 projecting from the tip 21 of the porcelain insulator 20. The center electrode 30 is formed by a cylindrical member which is made up of a core portion made of a metallic material such as Cu having a higher thermal conductivity and an external portion made of a metallic material such as a Ni-based alloy having higher thermal and corrosion resistances.

The ground electrode 40 is formed by a prismatic pole made of a Ni alloy whose main component is nickel and welded at a base 42 thereof directly to an end of the metal shell 10. The ground electrode 40 is, as clearly shown in FIG. 2, bent to an L-shape to have a tip 41 which faces at an inner side surface 43 thereof the tip 31 of the center electrode 30 through a spark gap 50.

Noble metal chips 35 and 45 are joined by laser welding to an end surface of the tip 31 of the center electrode 30 and the inner side surface 43 of the ground electrode 40, respectively. The laser welding results in formation of fused portions 34 and 44. The fused portions 34 are each formed by materials of the center electrode 30 and the noble metal chip 35 melted together. Similarly, the fused portions 44 are each formed by materials of the ground electrode 40 and the noble metal chip 45 melted together.

Each of the noble metal chips 35 and 45 is formed by a cylindrical member and laser-welded at an end thereof to a corresponding one of the center and ground electrodes 30 and 40. The noble metal chips 35 and 45 are aligned with a longitudinal center line C of the spark plug 100. The spark gap 50 is defined by an interval between the chips 35 and 45 which is, for example, 1 mm.

Each of the chips 35 and 45 is made of a noble metal such as Pt, Pt alloy, Ir, or Ir alloy. For example, the alloy containing an additive of at least one of Ir (iridium), Pt (platinum), Rh(rhodium), Ni(nickel), W(tungsten), Pd(palladium), Ru(ruthenium), Os(osmium), Al(aluminum), Y(yttrium), and $Y_2O_3$(diyttrium trioxide or yttria) may be employed.

The noble metal chip 35 of the center electrode 30 which is made of an Ir alloy containing 50 wt % of Ir and has a transverse sectional area A1 of 0.1 $mm^2$ to 1.15 $mm^2$, as taken in a direction perpendicular to the longitudinal center line C (i.e., a length of the chip 35), is preferably used in this embodiment.

The noble metal chip 45 of the ground electrode 40 which is made of a Pt alloy containing 50 wt % of Pt and has a transverse sectional area A2 of 0.1 $mm^2$ to 1.15 $mm^2$, as taken in a direction perpendicular to the longitudinal center line C (i.e., a length of the chip 45), is preferably used in this embodiment.

Figure 2:
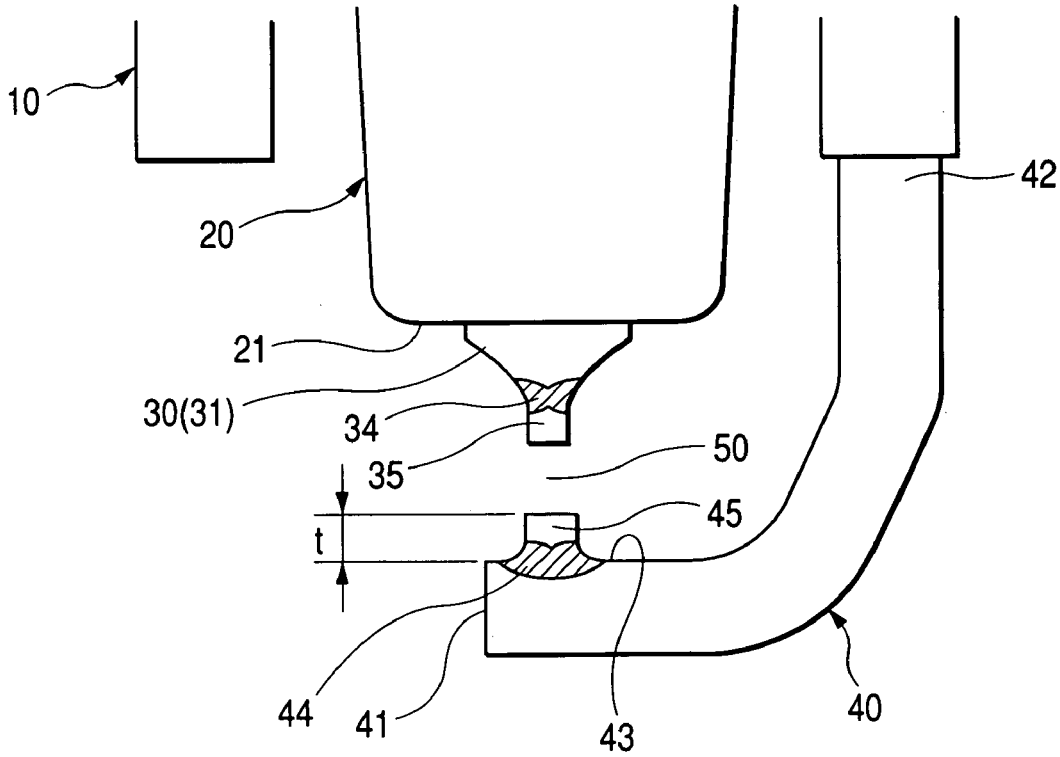
FIG. 2 is an enlarged view which shows tips of a ground and a center electrode of the spark plug of FIG. 1.

The amount of projection or longitudinal length t of the ground electrode chip 45, as illustrated in FIG. 2, projecting toward the center electrode 30 from the inner side surface 43 of the ground electrode 40 is 0.3 mm or more.

Chip Joining

The spark plug 100 includes, as discussed above, the center electrode 30 which is retained within the metal shell 10 with the tip 31 exposed outside the metal shell 10 and has the cylindrical noble metal chip 35 laser-welded to the tip 31 and the ground electrode 40 which is welded at the base 42 to the metal shell 10, bent at the middle thereof to have the tip 41 facing the center electrode 30 through the spark gap 50 and has the cylindrical noble metal chip 45 laser welded to the tip 41.

The spark plug 100 may be fabricated in a known manner, but the joining of the noble metal chip 45 to the tip 43 of the ground electrode 40 is achieved in this embodiment using a unique laser welding technique, as described below.

The noble metal chip 35 is first welded to the tip 31 of the center electrode 30 by laser. The center electrode 30 is inserted into the central chamber 22 of the porcelain insulator 20 and joined thereto using, for example, fused glass, thereby uniting the center electrode 30 and the porcelain insulator 20. Next, the ground electrode 40 is welded at the base 42 to the end of the metal shell 10, after which the assembly of the center electrode 30 and the porcelain insulator 20 is inserted into the metal shell 10. The metal shell 10 is crimped to unite with the porcelain insulator 20.

When welded to the metal shell 10, the ground electrode 40 still extends straight between the base 42 and the tip 41 without being bent, as illustrated in FIGS. 1 and 2. After the installation of the porcelain insulator 20 in the metal shell 10, but before the ground electrode 40 is bent, the noble metal chip 45 is placed on and welded to the inner side surface 43 of the ground electrode 40 using the laser welding technique, as discussed below. Afterwards, the ground electrode 40 is bent until the spark gap 50 reaches a desired value, thereby completing the spark plug 100.

Figure 3A:
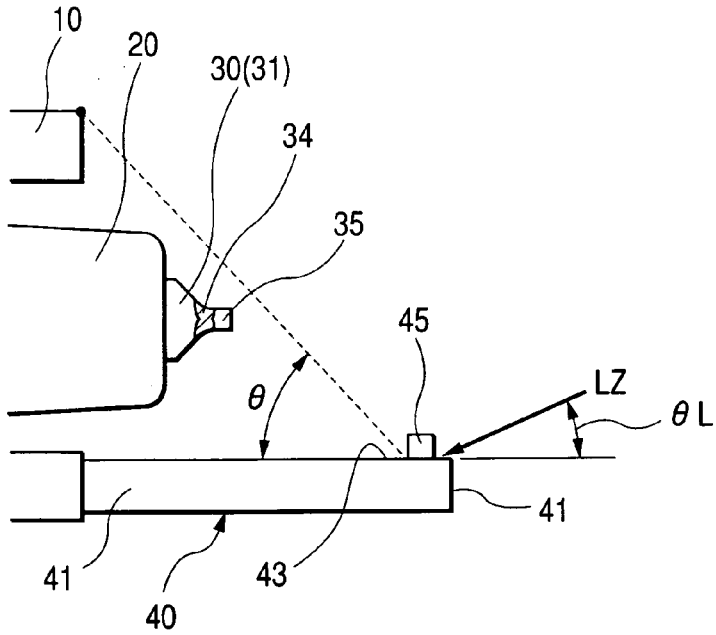
FIG. 3(*a*) is a side view which shows a noble metal chip to be welded to a ground electrode.
Figure 3B:
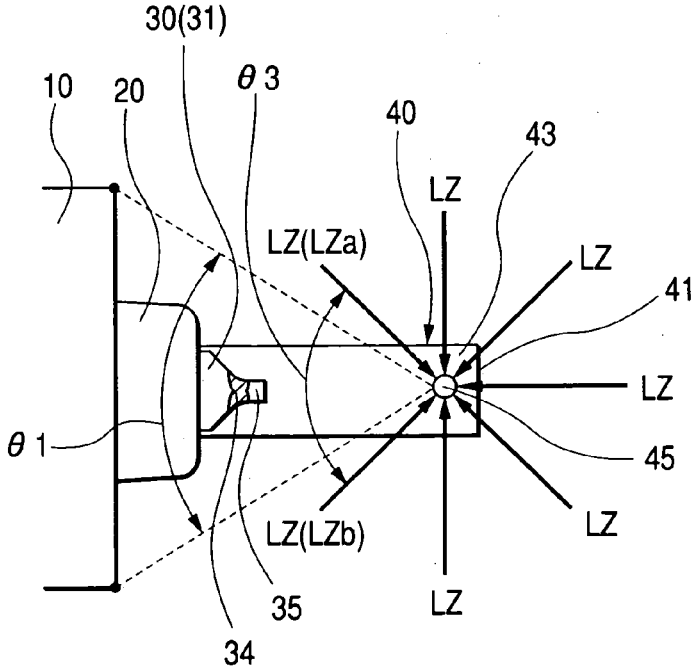
Figure 4A:
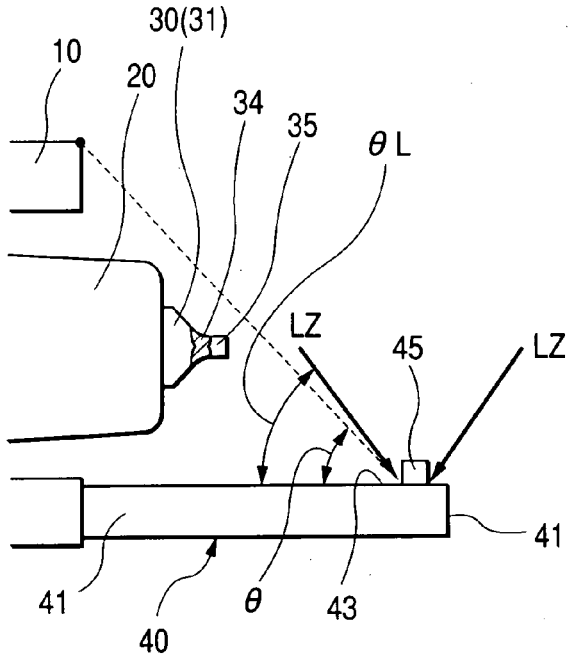
FIG. 4(a) (PRIOR ART)
FIG. 4(*a*) is a side view which shows a noble metal chip to be welded to a ground electrode by conventional laser welding.
Figure 4B:
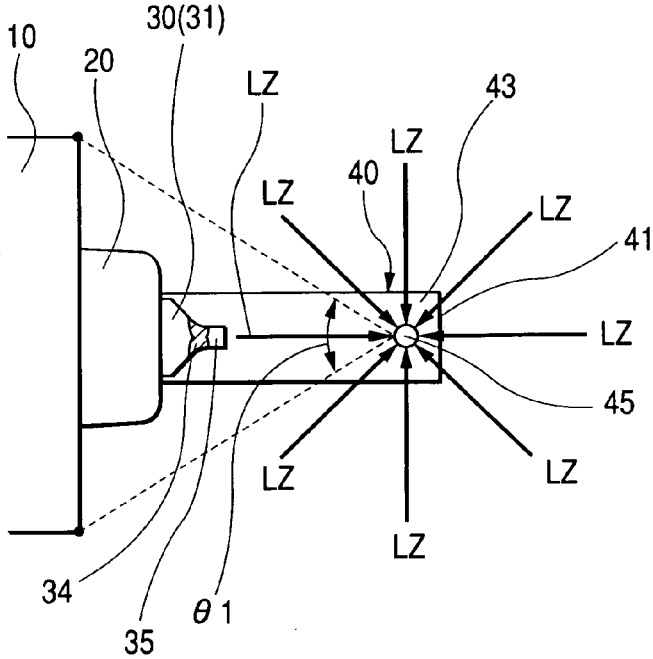
FIG. 4(b) (PRIOR ART)

FIGS. 3(*a*) and 3(*b*) illustrate how to joint the noble metal chip 45 to the ground electrode 40 by the laser welding in this embodiment. FIGS. 4(*a*) and 4(*b*) illustrate, as a comparative example, a conventional laser welding technique for joining the noble metal chip 45 to the ground electrode 40. FIGS. 3(*b*) and 4(*b*) are top views of FIGS. 3(*a*) and 4(*a*), respectively.

In either of the cases in FIGS. 3(*a*) and 3(*b*) and FIGS. 4(*a*) and 4(*b*), after the ground electrode 40 is welded to the metal shell 10, the noble metal chip 45 is placed at an end thereof on the inner side surface 43 of the ground electrode 40 extending straight. Subsequently, laser beams LZ are radiated to an interface between the noble metal chip 45 and the inner side surface 43 to fuse contact portions of the noble metal chip 45 and the ground electrode 40. This, as shown in FIG. 2, results in formation of fused portions 44 (also called weld nuggets) made up of the materials of the chip 45 and the ground electrode 40 melted together.

In FIGS. 3(*a*) and 4(*a*), θL represents the angle which a path along which each of the laser beams LZ travels (will also be referred to as a laser radiation path below) makes with the inner side surface 43 of the ground electrode 40. The angle θL will also be referred to as a radiation angle below. In the following discussion, symbols "LZ" will be used to indicate both the laser beams themselves and the laser radiation paths.

In FIG. 3(*b*), the angle which broken lines extending from the interface between the noble metal chip 45 of the ground electrode 40 to side edges of the metal shell 10 on the plane of projection thereof, as expanding over the inner side surface 43 of the ground electrode 40, makes with each other is defined as θ1.

The radiation paths LZ are, as clearly illustrated in FIG. 3(*b*), defined outside the angle θ1. Specifically, the laser beams LZ are emitted to the interface of the noble metal chip 43 with the ground electrode 40 outside the angle θ1. This is an essential feature in joining the noble metal chip 45 to the ground electrode 40 in this embodiment.

In other words, the angle θ1 is an obstruction range within which the metal shell 10 obstructs the traveling of the laser beams LZ when the ground electrode 40 extending straight is welded to the metal shell 10. Defining the radiation paths LZ outside the angle θ1, therefore, permits the laser beams LZ to be emitted to the noble metal chip 45 without any optical interferences with the metal shell 10. This allows the radiation angle θL which the radiation paths LZ makes with the inner side surface 43 of the ground electrode 40 to be minimized regardless of the metal shell 10. This also causes the depth of a portion (i.e., a weld nugget) of the noble metal chip 45 which is fused by the laser welding into the ground electrode 40 in a radius direction of the noble metal chip 45 to be maximized.

The conventional laser welding, as illustrated in FIGS. 4(*a*) and 4(*b*), is to emit the laser beams LZ around the circumference of the noble metal chip 45 at regular intervals. FIG. 4(*b*) illustrates for the case where the eight laser beams LZ are emitted at an interval of 45°, so that one of the laser beams LZ is within the angle θ1. This results in need for the radiation angle θL to be increased so that the laser beam LZ within the angle θ1 may be emitted to the noble metal chip 45 beyond the metal shell 10.

Specifically, if the angle which a line extending from an outside edge of the metal shell 10 to the interface between the noble metal chip 45 and the inner side surface 43 of the ground electrode 40 makes with the inner side surface 43 is, as shown in FIG. 4(*a*), defined as θ, the conventional laser welding sets the radiation angle θL greater than the angle θ (i.e., θL>θ), thus causing the laser beams LZ to be emitted to the inner side surface 43 of the ground electrode beyond the metal shell 10. On the other hand, the laser welding of this embodiment, as can be seen from FIG. 3(*a*), allows the radiation angle θL to be smaller than the angle θ, thereby ensuring a desired depth of a portion (i.e., a weld nugget) of the noble metal chip 45 which is fused by each of the laser beams LZ into the ground electrode 40 in the radius direction of the noble metal chip 45.

The laser welding of this embodiment will also be discussed below in detail.

If a line made by projecting the laser radiation paths LZ onto a plane extending over the inner side surface 43 of the ground electrode 40 before bent is defined as a laser path projected line LZ, an angle θ3 which adjacent two LZa and LZb of the laser path projected lines LZ, as shown in FIG. 3(*b*), closest to the metal shell 10 make with each other is set greater than the angle θ1. This permits the laser beams LZ to be emitted to the noble metal 45 at the radiation angle θL of, for example, 20° smaller than the angle θ, thus allowing, as already described, the depth of a portion of the noble metal chip 45 which is fused by each of the laser beams LZ into the ground electrode 40 in the radius direction of the noble metal chip 45 to be maximized. This results in a decreased unfused area on the interface the noble metal chip 45 and the inner side surface 43 of the ground electrode 40, thereby improving the reliability of the joint between the noble metal chip 45 and the ground electrode 40.

FIGS. 3(*a*) and 3(*b*) show an example of the laser welding of this embodiment. The number of the laser beams LZ to be used and the manner in which the laser beams LZ are emitted may be changed, as needed, as described below.

The laser beams LZ may be radiated, in sequence, to the noble metal chip 45 from the same direction while an assembly of the ground electrode 40 and the metal shell 10 is being rotated on a table about a longitudinal center line of the noble metal chip 45. Alternatively, the laser beams LZ may be radiated from different directions to the noble metal chip 45 which is placed stationary.

As apparent from the above discussion, the method of laser welding of this embodiment permits the noble metal chip 45 to be welded to the ground electrode 40 which is already joined to the metal shell 10 without sacrificing the reliability of the weld of the noble metal chip 45 to the ground electrode 40. This eliminates the need for the noble metal chip 45 to be welded to the ground electrode 40 before the ground electrode 40 is joined to the metal shell 10.

Structure of Weld of Ground Electrode Chip

The structure of the weld of the noble metal chip 45 produced by the above described laser welding will be described below with reference to FIGS. 5(*a*) and 5(*b*).

Figure 5A:
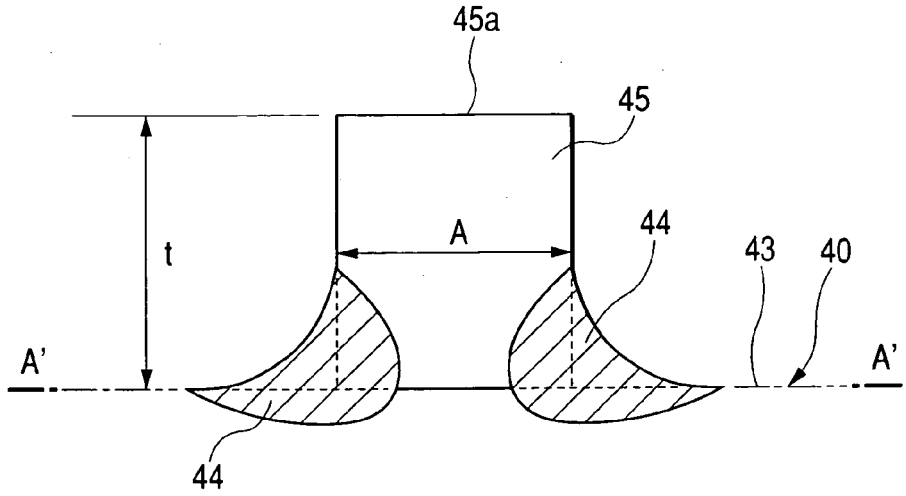
FIG. 5(*a*) is a vertical sectional view, as taken along the line B'—B' in FIG. 5(*b*), which shows a weld between a noble metal chip and a ground electrode.
Figure 5B:
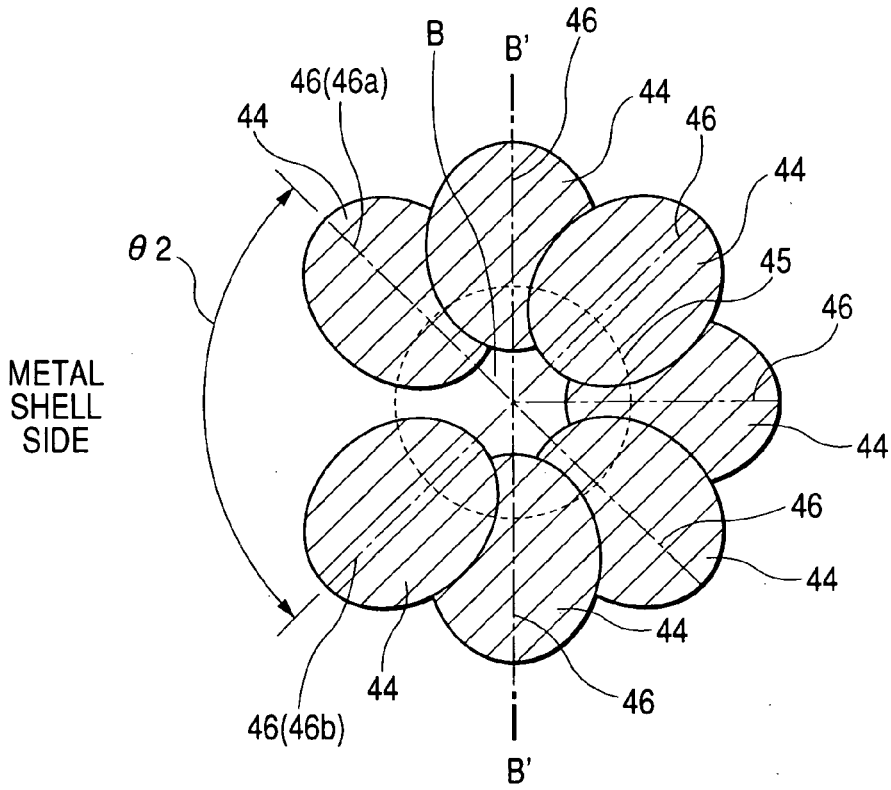

FIG. 5(*a*) is a vertical sectional view, as taken along the line B'—B' in FIG. 5(*b*). FIG. 5(*b*) is a transverse sectional view, as taken along the line A'—A' in FIG. 5(*a*).

FIG. 5(*b*) shows a sectional area extending over an interface between the noble metal chip 45 and the inner side surface 43 of the ground electrode 40. Broken lines indicate profiles of portions of the noble metal chip 45 and the inner side surface 43 of the ground electrode 40 before they are melted together by the laser welding.

In the following discussion, chain lines in FIG. 5(*b*) which extend through the centers of sectional areas of the fused portions 44 (i.e., weld nuggets), as taken along the welded interface between the noble metal chip 45 and the inner side surface 43 of the ground electrode 40, and are oriented inward of the noble metal chip 45 will be each referred to as a weld nugget center line. In the example of FIG. 5(*b*), each of the fused portions 44 is an ellipse in cross section. Each of the weld nugget center lines, thus, coincides with a long axis of the ellipse.

Each of the weld nugget center lines extends along a corresponding one of the laser path projected line LZ, as illustrated in FIG. 3(*b*). The weld nugget center lines substantially identical in orientation with the laser path projected lines LZ. In other words, the laser path projected lines LZ in FIG. 3(*b*) is identical in layout with the weld nugget center lines in FIG. 5(*b*).

The laser radiation paths LZ, as described above, lie outside the range of the angle θ1 in FIG. 3(*b*) defined on the side of the base 42 of the ground electrode 40. The weld nugget center lines, thus, lie outside the range of the angle θ1.

The angle θ3 which adjacent two LZa and LZb of the projected lines LZ, as shown in FIG. 3(*b*), closest to the metal shell 10 make with each other is, as described above, set greater than the angle θ1. The angle θ2 which adjacent two 46*a* and 46*b* of the weld nugget center lines, as shown in FIG. 5(*b*), closest to the metal shell 10 make with each other is, thus, greater than the angle θ1. In the example of FIG. 5(*b*), the angle θ2 is substantially identical with the angle θ3.

Specifically, there is no weld nugget center line between two of the weld nugget center lines lying adjacent to each other across the angle θ1. In the example of FIG. 5(*b*), the seven weld nugget center lines are arrayed outside the range of the angle θ1.

Therefore, the arrangement of the radiation paths LZ outside the angle θ1, as described above, permits the laser beams LZ to be emitted to the noble metal chip 45 without any optical interferences with the metal shell 10.

The longitudinal length t of the ground electrode chip 45 projecting from the inner side surface 43 of the ground electrode 40 is 0.3 mm or more.

In the following discussion, a transverse sectional area of a portion of the noble metal chip 45 closest to the fused portions 44, as shown in FIG. 5(*a*), will be defined as A (will be referred to as a fused portion closest sectional area below). On the interface of the noble metal chip 45 with the inner side surface 43 of the ground electrode 40 (i.e., the A'—A' sectional area), an unfused portion exists, as clearly shown in FIG. 5(*b*), which is a portion of the noble metal chip 45 remaining unfused with the inner side surface 43 of the ground electrode 40. A sectional area of the unfused portion will be defined as B.

In this embodiment, the percentage C (will be referred to as an unfused sectional area percentage below) of the sectional area B of the unfused portion within a range, as indicated by a broken line in FIG. 5(*b*), of the fused portion closest sectional area A of the noble metal chip 45 is 50% or less, preferably 30% or less, (i.e., $C=100B/A\ \% \leqq 50\%$).

It has been found that the size of the fused portions 44 which results in an unfused sectional area percentage C of 50% or less ensures the reliability of the joint between the ground electrode 40 and the noble metal chip 45 having a longitudinal length t of 0.3 mm or more. The basis for this will be described later with reference to FIG. 7.

A desired value of the longitudinal length t may be derived by selecting the length of the noble metal chip 45 before welded to the ground electrode 40. A desired value of the unfused sectional area percentage C may be obtained by selecting radiating conditions of the laser beams LZ.

The joint of the noble metal chip 45 to the ground electrode 40 is, in practice, achieved by, after the ground electrode 40 is welded to the metal shell 10, tack-welding the noble metal chip 45 to the inner side surface 43 in resistance welding and emitting the laser beams LZ around the interface between the noble metal chip 45 and the inner side surface 43 under the following three conditions.

The first condition is that the laser radiation paths LZ lie outside the angle θ1 which the broken lines, as illustrated in FIG. 3(*b*), extending from the interface between the noble metal chip 45 of the ground electrode 40 to the side edges of the metal shell 10 on the plane of projection thereof, as expanding over the inner side surface 43 of the ground electrode 40, make with each other.

The second condition is that the longitudinal length t of the noble metal chip 45 projecting from the inner side surface 43 of the ground electrode 40 is 0.3 mm or more. This may be satisfied by using the noble metal chip whose initial length is 3 mm or more.

The third condition is that the unfused sectional area percentage C that is the percentage of the sectional area B of the unfused portion within the range of the fused portion closest sectional area A of the noble metal chip 45 is 50% or less.

The reason that longitudinal length t of the noble metal chip 45 projecting from the inner side surface 43 of the ground electrode 40 is set greater than 0.3 mm or more will be described below with reference to FIGS. 6(*a*) and 6(*b*).

Figure 6A:
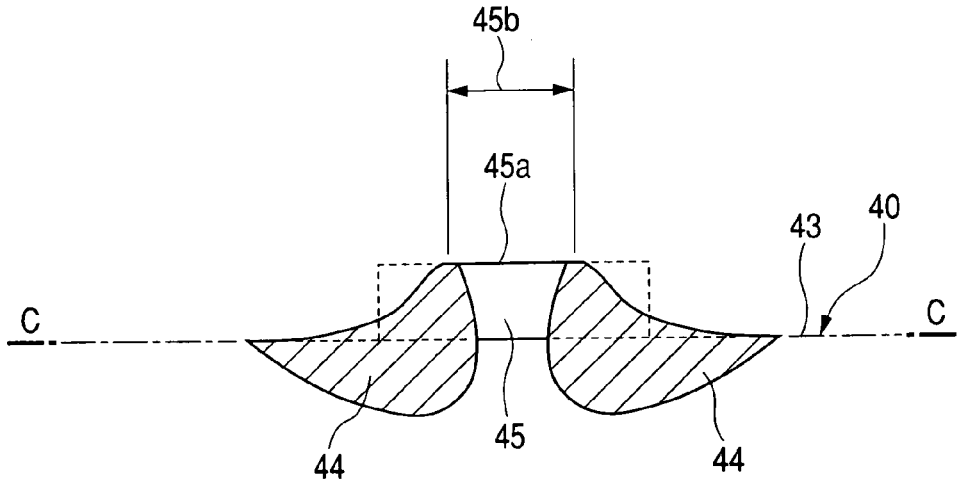
FIG. 6(*a*) is a vertical sectional view, as taken along the line D—D in FIG. 6(*b*), which shows a weld between a noble metal chip and a ground electrode when fused portions reach a spark discharging surface of the ground electrode.
Figure 6B:
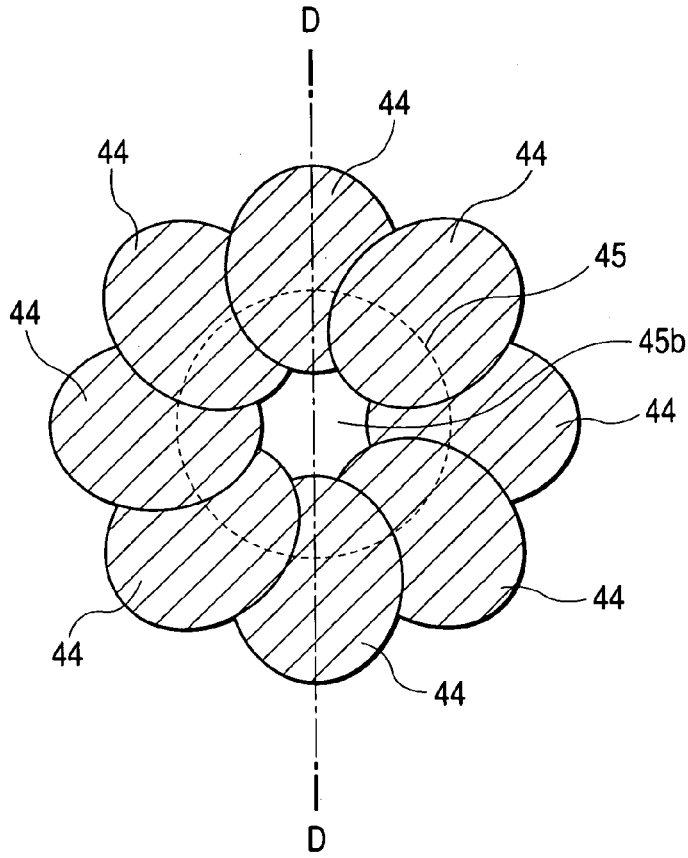

FIG. 6(*a*) is a longitudinal sectional view, as taken along the line D—D in FIG. 6(*b*), which shows an internal structure of the joint between the noble metal chip 45 and the ground electrode 40 in a case where the fused portions 44 extend to a spark discharging surface 45*a* (i.e., an upper end surface) of the noble metal chip 45 facing the noble metal chip 35 of the center electrode 30. FIG. 6(*b*) is a transverse sectional view, as taken along the line C—C in FIG. 6(*a*), which shows the interface between the noble metal chip 45 and the inner side surface 43 of the ground electrode 40. In FIGS. 6(*a*) and 6(*b*), broken lines indicate the profiles of the noble metal chip 45 and the inner side surface 43 of the ground electrode 40 before they are welded together.

The spark discharging surface 45*a* has an unfused area 45*b* which excludes the fused portions 44, that is, which has not undergone the laser welding. Usually, the fused portions 44 are more sensitive to sparks than an unwelded portion of the noble metal chip 45, thus resulting in a decrease in wear resistance thereof. If, therefore, the fused portions occupy at least a portion of the spark discharging surface 45*a*, it will cause the fused portions 44 to be worn to a greater extent than in the unwelded portion of the noble metal chip 45, which results, in the worst case, in dislodgement of the noble metal chip 45. It is, thus, advisable that the unfused area 45*b* occupy the whole of the spark discharging surface 45*a*. In other words, an area percentage of the unfused area 45*b* within an area of the spark discharging surface 45*a* before the noble metal chip 45 is laser-welded to the ground electrode 40 (=[(area of the unfused area 45*b*)/(area of the spark discharging surface 45*a* before the laser welding)]×100) is preferably 100%. Such an area percentage will also be referred to as an unfused area percentage below.

Figure 7:
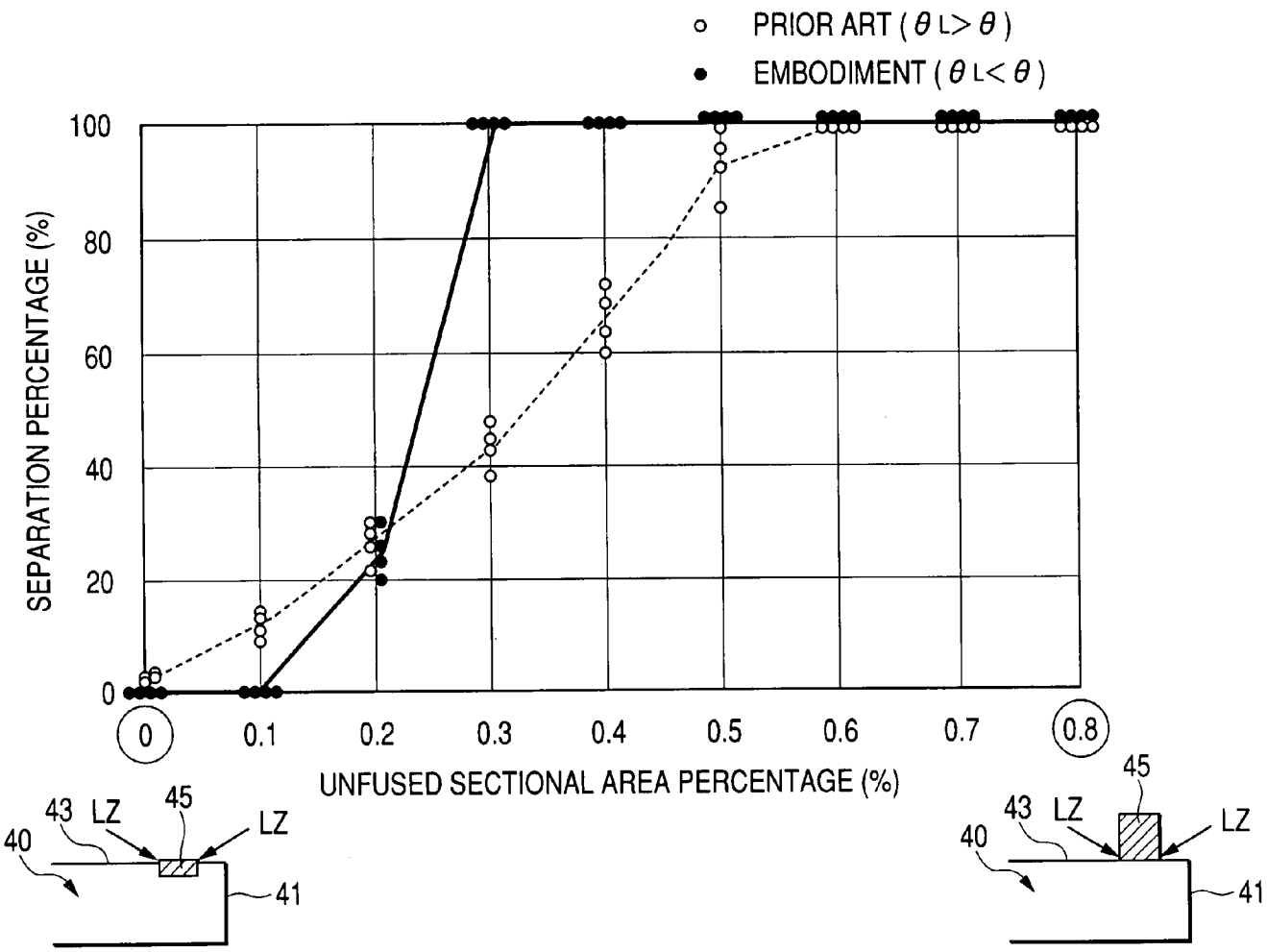
FIG. 7 is a graph which shows a relation between the length of a noble metal chip on a ground electrode and an unfused area percentage at a weld between the noble metal chip and the ground electrode.

FIG. 7 is a graph which shows a relation between the longitudinal length t of the noble metal chip 45 and the unfused area percentage which was experimentally measured in the following manner.

We prepared two types of spark plug samples. The first type spark plug samples were subjected to the laser welding under the conditions in this embodiment and made so that the angle θL was smaller than the angle θ1. These samples are indicated by black plots in the graph. The second type spark plug samples were subjected to the conventional laser welding and made so that the angle θL was greater than the angle θ1. These samples are indicated by while plots in the graph.

The graph of FIG. 7 shows that in either of the first and second types, the unfused area percentage increases with an increase in the longitudinal length t of the noble metal chip 45, thus resulting in an increase in the wear resistance of the noble metal chip 45 and that the second type spark plug samples subjected to the conventional laser welding show an unfused area percentage of 100% when the longitudinal length t is 0.6 mm or more, while the first type spark plug samples subjected to the laser welding of this embodiment show an unfused area percentage of 100% when the longitudinal length t is 0.3 mm or more.

When the unfused area percentage is 100%, that is, when the fused portions 44 do not occupy the spark discharging surface 45*a*, the noble metal chip 45 has a maximum wear resistance. It is, therefore, preferable in terms of the wear resistance that the second type spark plug samples subjected to the conventional laser welding have a longitudinal length t of 0.6 mm or more, while the first type spark plug samples subjected to the laser welding of this embodiment have a longitudinal length t of 0.3 mm or more.

We have found that if the longitudinal length t is shorter, the spark plug 100 of this embodiment has the wear resistance higher than that of the conventional spark plugs. The increase in the longitudinal length t will result in an increase in production cost of the spark plug 100. The laser welding of this embodiment is, thus, preferable in terms of the wear resistance and the production costs.

For the above reasons, the noble metal chip 45 of the spark plug 100 has a longitudinal length t of 0.3 mm or more.

The reason that the unfused sectional area percentage C is set smaller than or equal to 50% will be described below.

We prepared spark plug samples having different dimensions of welds between the noble metal chip 45 and the ground electrode 40 and performed durability tests on them using a 6-cylinder 2000 cc engine.

Each of the spark plug samples was installed in the engine. The engine was idled for one minute and then run at a full speed of 6000 rpm. for one minute. This cycle was repeated for 100 hours. After the durability tests, we evaluated the durability of the spark plug samples in a manner, as discussed below, in terms of a percentage of a separated portion of an interface between the noble metal chip 45 and each of the fused portions 44 (will also be referred to as a chip-fused portion separation percentage below) and a percentage of a separated portion of an interface between each of the fused portions 44 and the ground electrodes 40 (will also be referred to as a fused portion-electrode separation percentage below).

Figure 8:
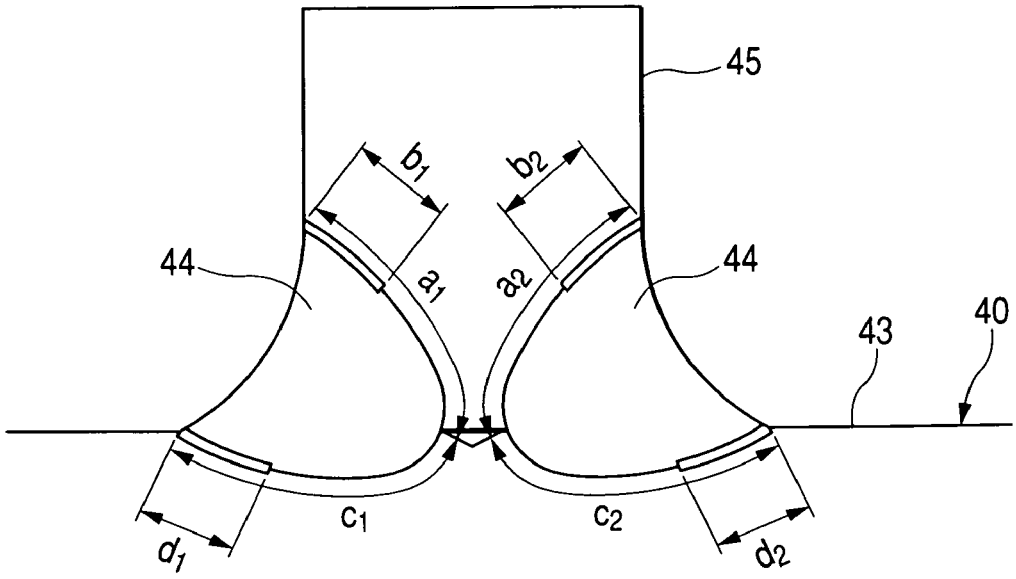
FIG. 8 is an enlarged view which shows dimensions of laser-fused portions formed between a noble metal chip and a ground electrode.

The chip-fused portion separation percentage is expressed by $\{(b1+b2)/(a1+a2)\}\times 100$ (%). The fused portion-electrode separation percentage is expressed by $\{(d1+d2)/(c1+c2)\}\times 100$ (%). a1 and a2 indicate, as shown in FIG. 8, lengths of the interfaces between the fused portions 44 and the noble metal chip 45. c1 and c2 indicate lengths of the interfaces between the fused portions 44 and the inner side surface 43 of the ground electrode 40. b1, b2, d1, and d2 indicate lengths of the separated portions of the interfaces, respectively. The lengths and shapes of the separated portions may be observed using a metallographic microscope. The greater of the chip-fused portion separation percentage and the fused portion-electrode separation percentage was selected as a separation percentage to evaluate the durability or joint strength of the weld between the noble metal chip 45 and the ground electrode 40 of each spark plug sample.

Figure 9:
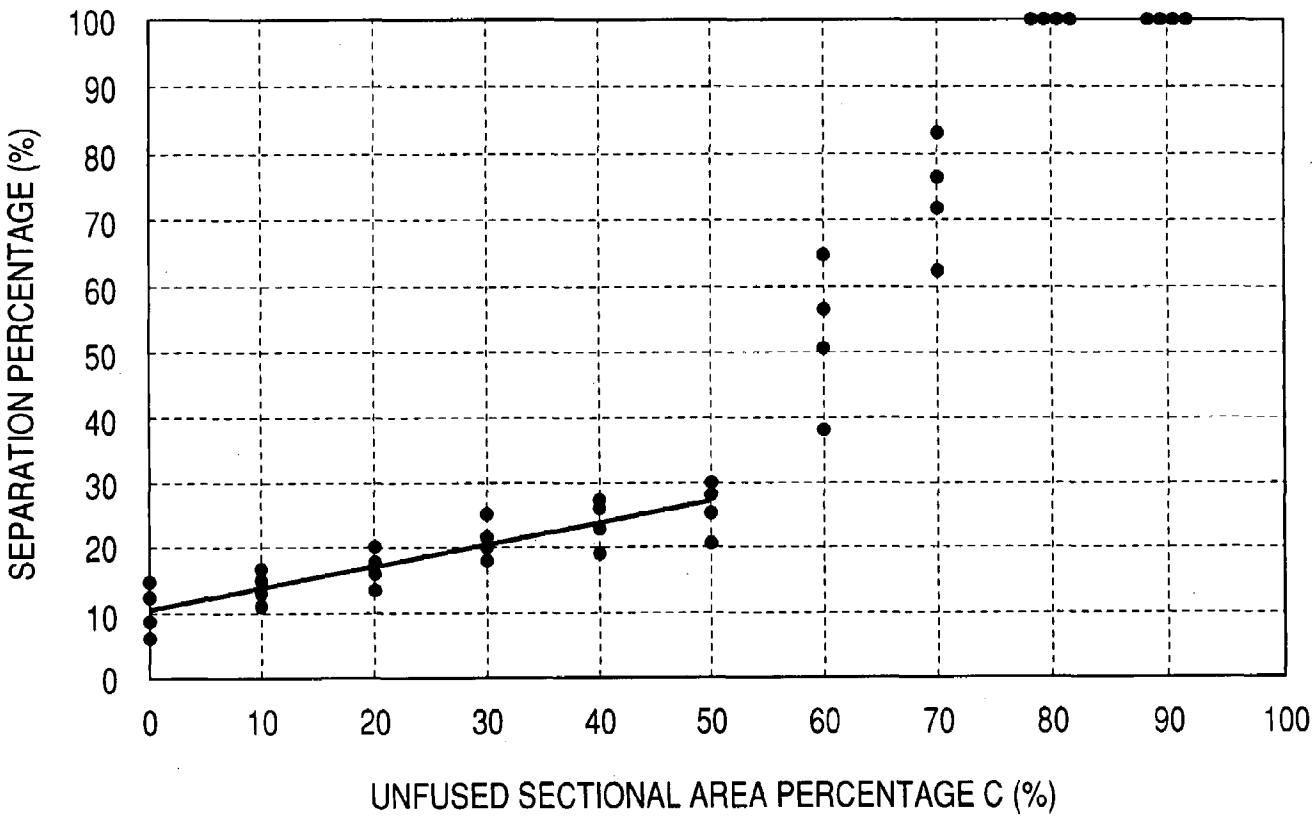
FIG. 9 is a graph which shows a relation between a separation percentage of an interface between a noble metal chip and a ground electrode and an unfused sectional area percentage.

FIG. 9 represents the effects of the unfused sectional area percentage C and the separation percentage on the mechanical strength of the weld between the noble metal chip 45 and the ground electrode 40. The noble metal chip 45 used in each of the spark plug samples was made of a Pt alloy cylindrical member which had a diameter of 0.7 mm (the fused portion closest sectional area A=0.38 $mm^2$ in FIG. 5(*a*)) and a length of 0.8 mm. The ground electrode 40 was made of a Ni-based alloy such as Inconel (trade mark) and had a width of 2.8 mm and a thickness of 1.6 mm. The laser emission angle θL, as shown in FIG. 3(*a*), was 20°.

In the graph of FIG. 9, the ordinate axis represents the separation percentage (%). The abscissa axis represents the unfused sectional area percentage C. We used the four spark plug samples in each value of the unfused sectional area percentage C.

The graph shows that the smaller the unfused sectional area percentage C, the lower the separation percentage and that when the unfused sectional area percentage C is 50% or less, the separation percentage is 30% or less, and a variation in the separation percentage is small. It is, thus, appreciated that the spark plug samples whose unfused sectional area percentage C is 50% or less is excellent in the reliability of the joint between the noble metal chip 45 and the ground electrode 40.

The graph also shows that when the unfused sectional area percentage C exceeds 50%, the separation percentage becomes great suddenly, and a variation in the separation percentage also becomes great, which results in a great decrease in the reliability of the joint between the noble metal chip 45 and the ground electrode 40. This is because when the sectional area of the unfused portion of the noble metal chip 45 is great, it undermines the activities of the fused portions 44 as a thermal stress absorber.

The unique features of this embodiment are summarized as follows: The spark plug 100 has the noble metal chips 35 and 45 laser-welded to the opposed surfaces 31 and 43 of the center electrode 30 and the ground electrode 40. The longitudinal length t of the noble metal chip 45 projecting from the surface 43 of the ground electrode 40 is 0.3 mm or more. The joint of the noble metal chip 45 to the ground electrode 40 is achieved by emitting laser beams to an interface between the noble metal chip 45 and the inner side surface 43 of the ground electrode 40 to form the fused portions 44 (i.e., weld nuggets). The weld nugget center lines 46 lie outside the angle θ1 which the broken lines, as illustrated in FIG. 3(*b*), extending from the interface between the noble metal chip 45 of the ground electrode 40 to the side edges of the metal shell 10 on the plane of projection thereof, as expanding over the inner side surface 43 of the ground electrode 40, makes with each other. The unfused sectional area percentage C is 50% or less. The angle θ2 which adjacent two 46*a* and 46*b* of the weld nugget center lines, as shown in FIG. 5(*b*), closest to the metal shell 10 make with each other is greater than the angle θ1.

Specifically, the joint of the noble metal chip 45 to the ground electrode 40 is achieved by tack-welding the noble metal chip 45 to the inner side surface 43 and emitting the laser beams around the interface between the noble metal chip 45 and the inner side surface 43 before the ground electrode 40 is bent at right angles to form the spark gap 50 between the noble metal chips 35 and 45. The laser radiation paths LZ along which the laser beams travel lie outside the angle θ1. The angle θ3 which adjacent two LZa and LZb of the projected lines LZ, as shown in FIG. 3(*b*), closest to the metal shell 10 make with each other is greater than the angle θ1. The laser welding in this manner permits the laser beams to be emitted without any optical interferences with the metal shell 10 and achieves a desired depth of a portion of the noble metal chip 45 which is fused by the laser beams into the ground electrode 40.

The longitudinal length t of the noble metal chip 45 projecting from the surface 43 of the ground electrode 40 is, as described above, 0.3 mm or more. The unfused sectional area percentage C is 50% or less. This ensures the reliability of the joint between the noble metal chip 45 and the ground electrode 40.

The laser welding of this embodiment is performed after the ground electrode 40 is joined to the metal shell 10, but before it is bent to form the spark gap 50, thereby increasing ease of improvement of the productivity of the spark plug 100 and reliability of the joint of the noble metal chip 45 to the ground electrode 40.

The noble metal chip 35 of the center electrode 30 is, as described above, made of an Ir alloy containing 50 wt % of Ir. The chip 45 of the ground electrode 40 is made of a Pt alloy containing 50 wt % of Pt. The noble metal chip 35 preferably has a transverse sectional area A1 of 0.1 $mm^2$ to 1.15 $mm^2$, as taken in a direction perpendicular to the longitudinal center line C in FIG. 1. Similarly, the chip 45 of the ground electrode 40 preferably has a transverse sectional area A2 of 0.1 $mm^2$ to 1.15 $mm^2$, as taken in the direction perpendicular to the longitudinal center line C. The reason for this will be described below.

The noble metal chip 35 of the center electrode 30 is usually subjected to greater wear arising from sparks developed within the spark gap 50. The Ir alloy is higher in melt point and thus used as material for the noble metal chip 35. The noble metal chip 45 of the ground electrode 40 is usually subjected to greater oxidization/volatilization-caused wear. The Pt alloy has a higher resistance to the oxidization and the volatilization and is thus used as material for the noble metal chip 45. This results in a greatly increased service life of the spark plug 100.

When the transverse sectional areas A1 and A2 of the noble metal chips 35 and 45 are less than 0.1 $mm^2$, it will result in a great decrease in heat transmission thereof which leads to accelerated rise in temperature of the chips 35 and 45. This result in excessive wear of the chips 35 and 45 or preignition of the fuel. Conversely, when the transverse sectional areas A1 and A2 of the noble metal chips 35 and 45 are more than 1.15 $mm^2$, it will result in decreased ignitability of the fuel. This is because the noble metal chips 35 and 45 cool the flame kernel during growth thereof, thus reducing the flame kernel growth.

Each of the chips 35 and 45, as described above, preferably contains, as an additive, at least one of Ir (iridium), Pt (platinum), Rh (rhodium), Ni (nickel), W (tungsten), Pd (palladium), Ru (ruthenium), Os (osmium), Al (aluminum), Y (yttrium), and $Y_2O_3$ (diyttrium trioxide or yttria). The use of such an additive enhances the wear resistance and mechanical strength of the noble metal chips 35 and 45, thus decreasing the degree of breakage or cracks thereof arising from exposure to intense heat.

The second embodiment of the invention will be described below which is provided for further improving the reliability of the joint between the noble metal chip 45 and the ground electrode 40. The same reference as employed in the first embodiment will refer to the same parts, and explanation thereof in detail will be omitted here.

Figure 10:
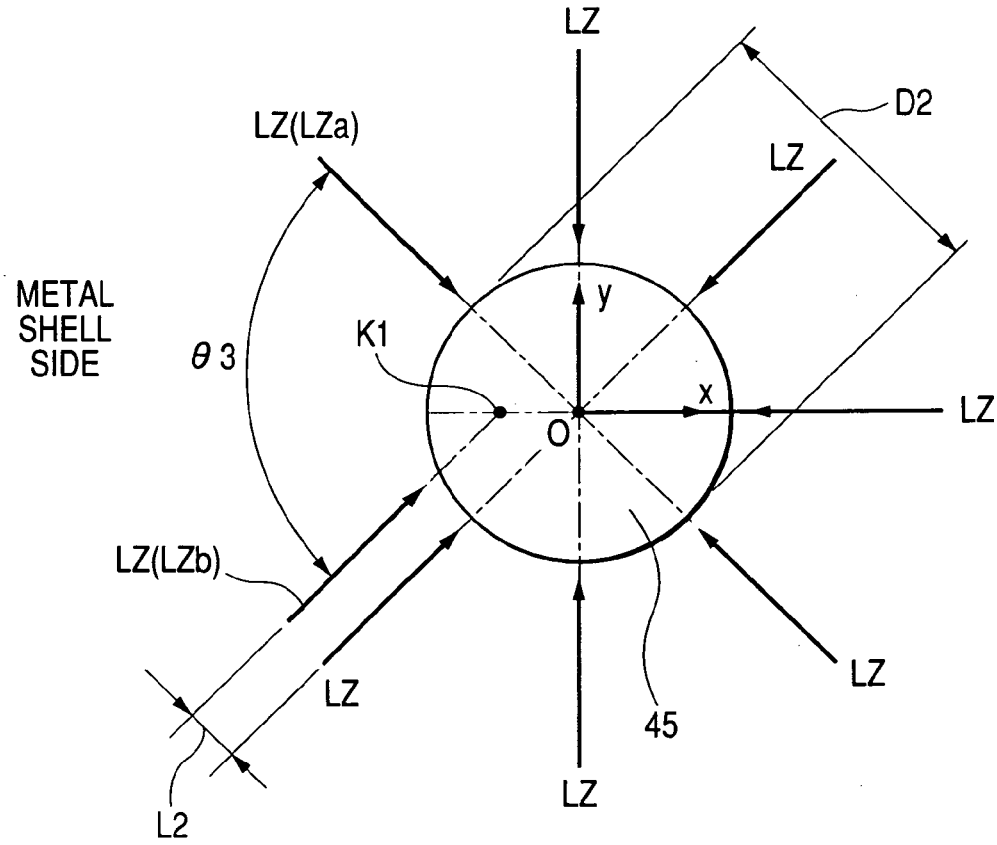
FIG. 10 is a top view which shows orientations of laser beams emitted to a noble metal chip.

FIG. 10 is a top view which shows the noble metal chip 45 which is placed on the inner side surface 43 of the ground electrode 40 before bent and which is subjected to laser welding in the second embodiment.

In the drawing, "LZ" indicates, like the first embodiment, both the laser radiation path along which the laser beam travels and the laser path projected line defined by projecting the laser radiation path onto a plane extending over the inner side surface 43 of the ground electrode 40 before bent. "O" indicates the center of a transverse sectional area of the noble metal chip 45 of the ground electrode 40. "x" indicates a line extending through the center O in parallel to the longitudinal center line of the ground electrode 40 between the base 42 and the tip 41. "y" indicates a line extending through the center O perpendicular to the line x.

It is the feature of the invention that at least one of intersections of adjacent two (i.e., LZa and LZb) of the laser path projected lines lying outside the angle θ1 with the line x on a plane traversing the longitudinal center line of the noble metal chip 45 is located closer to the base 42 of the ground electrode 40 than the center O.

In the example of FIG. 10, the intersection of the laser path projected line LZb with the line x lies closer to the metal shell 10 (i.e., the base 42 of the ground electrode 40) than the center O.

The laser welding of this embodiment is achieved in the following manner. First, the assembly of the ground electrode 40 with the noble metal chip 45 and the metal shell 10 is prepared and rotated about the longitudinal center line of the noble metal chip 45. Next, laser beams are emitted, in sequence, toward the center O along the laser radiation paths LZ corresponding to seven of the laser path projected lines LZ except the line LZb. Finally, the assembly is moved in a direction to perpendicular to the last one of the laser radiation paths LZ to define the laser path projected line LZb oriented to the center O on the plane extending over the transverse section of the noble metal chip 45. The laser beam is emitted along the laser radiation path LZ coinciding with the laser path projected line LZb.

Figure 11A:
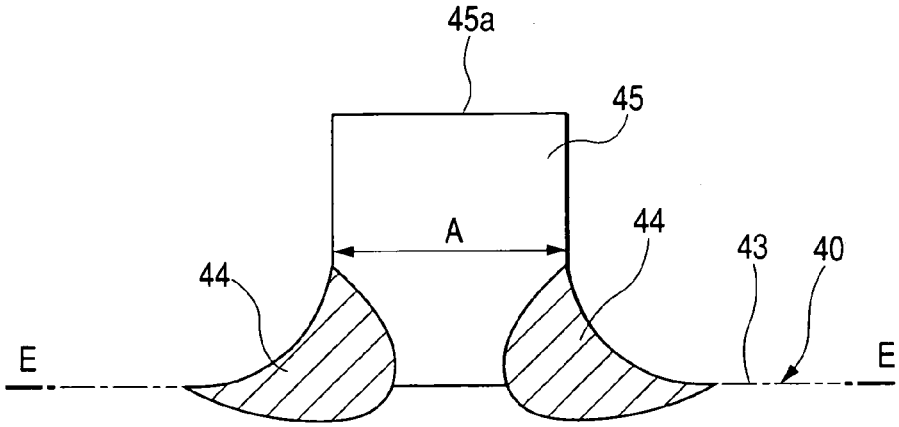
FIG. 11(*a*) is a longitudinal sectional view, as taken along the line F—F in FIG. 11(*b*), which shows a noble metal chip to be welded to a ground electrode in the second embodiment of the invention.
Figure 11B:
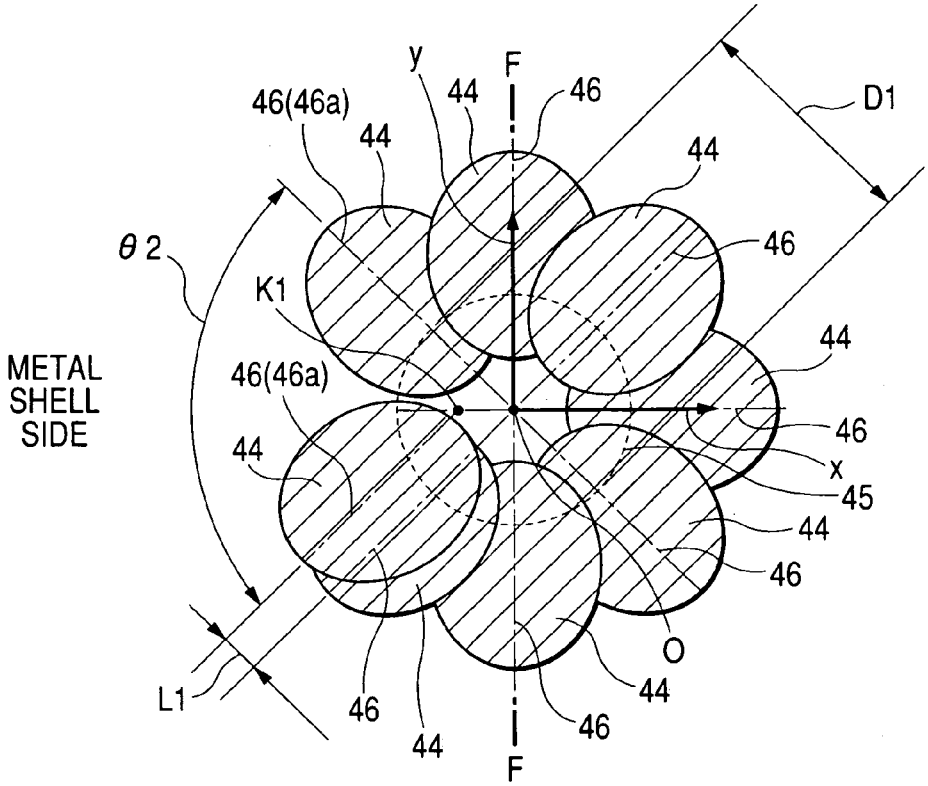

FIGS. 11(*a*) and 11(*b*) show the fused portions 44 (i.e. weld nuggets) formed by the above laser welding. FIG. 11(*a*) is a vertical sectional view, as taken along the line F—F in FIG. 11(*b*). FIG. 11(*b*) is a transverse sectional view, as taken along the line E—E in FIG. 11(*a*).

As can be seen from the drawings, at least one of intersections of adjacent two of the weld nugget center lines 46 lying across the angle θ1, namely, the weld nuggets center lines 46*a* and 46*b* with the line x lies closer to the base 42 of the ground electrode 40 than the center O on the plane traversing the longitudinal center line of noble metal chip 45 which extends perpendicular to the inner side surface 43 of the ground electrode 40.

Specifically, the intersection K1 of a lower one of the weld nugget center lines 46*a* and 46*b*, as viewed in FIG. 11(*b*), namely the weld nugget center line 46*b* with the line x is located closer to the metal shell 10 than the center O. In other words, the intersection K1 lies closer to the base 42 of the ground electrode 40 than the center O.

The laser welding of this embodiment serves to form the many fused portions 44 around a portion of the periphery of the noble metal chip 45 close to the base 42 of the ground electrode 40 as compared with the first embodiment. This results in a decrease in the sectional area B of the unfused portion of the noble metal chip 45 thereby increasing the reliability of the joint between the noble metal chip 45 and the ground electrode 40.

The greater of widths of the noble metal chip 45 in directions perpendicular to the laser path projected lines LZa and LZb is, as shown in FIG. 10, defined as D2. The interval between one of the laser path projected lines LZa and LZb (i.e., the line LZb in FIG. 10) closer to the base 42 of the ground electrode 40 and a line extending through the center O in parallel to the laser path projected line LZb is defined as L2. In order to further improve the reliability of the joint between the noble metal chip 45 and the ground electrode 40, the interval L2 is preferably less than or equal to 0.5 times the width D2. This may be achieved easily by adjusting the distance the assembly of the ground electrode 40 and the metal shell 10 moves along the line x.

The weld of the noble metal chip 45 to the ground electrode 40 achieved by the laser-welding meeting the above dimensional requirements will be described with reference to FIGS. 11(*a*) and 11(*b*).

In FIG. 11(*b*), the greater of widths of the noble metal chip 45 in directions perpendicular to the weld nuggets center lines 46*a* and 46*b* located adjacent to each other across the angle θ1 is defined as D1. Before the spark plug chip 1 is used, the spark discharging surface 45*a* of the noble metal chip is not yet subjected to the wear. The width D1 is, therefore, identical with the width D2.

The interval between one of the weld nugget center lines 46*a* and 46*b* (i.e., the center line 46*b* in FIG. 11(*b*)) closer to the base 42 of the ground electrode 40 and a line extending through the center O in parallel to the weld nugget center line 46*b* is defined as L1. The weld nugget center line 46 coincide with the laser radiation paths LZ two-dimensionally. The interval L1 is, therefore, identical with the interval L2 and less than or equal to 0.5 times the width D1.

The laser welding of this embodiment in which a laser beam is emitted to form the fused portion 44 which extends along one of the laser path projected lines LZa and LZb closer to the base 42 of the ground electrode 40 on a plane traversing the noble metal chip 45 works to minimize a recess or weld dimple formed in the fused portion 44 along the weld nugget center line 44 coinciding with the laser path projected line LZb. This is because when the interval L1 (L2) is greater than 0.5 times the width D1 (D2), it causes the laser beam LZ to be emitted to a peripheral portion of the noble metal chip 45 which is smaller in volume, so that it may melt easily and disappear.

We performed researches, as discussed below, and found beneficial effects produced by the above dimensional requirements wherein the interval L1 (L2) is less than or equal to 0.5 times the width D1 (D2).

Figure 12:
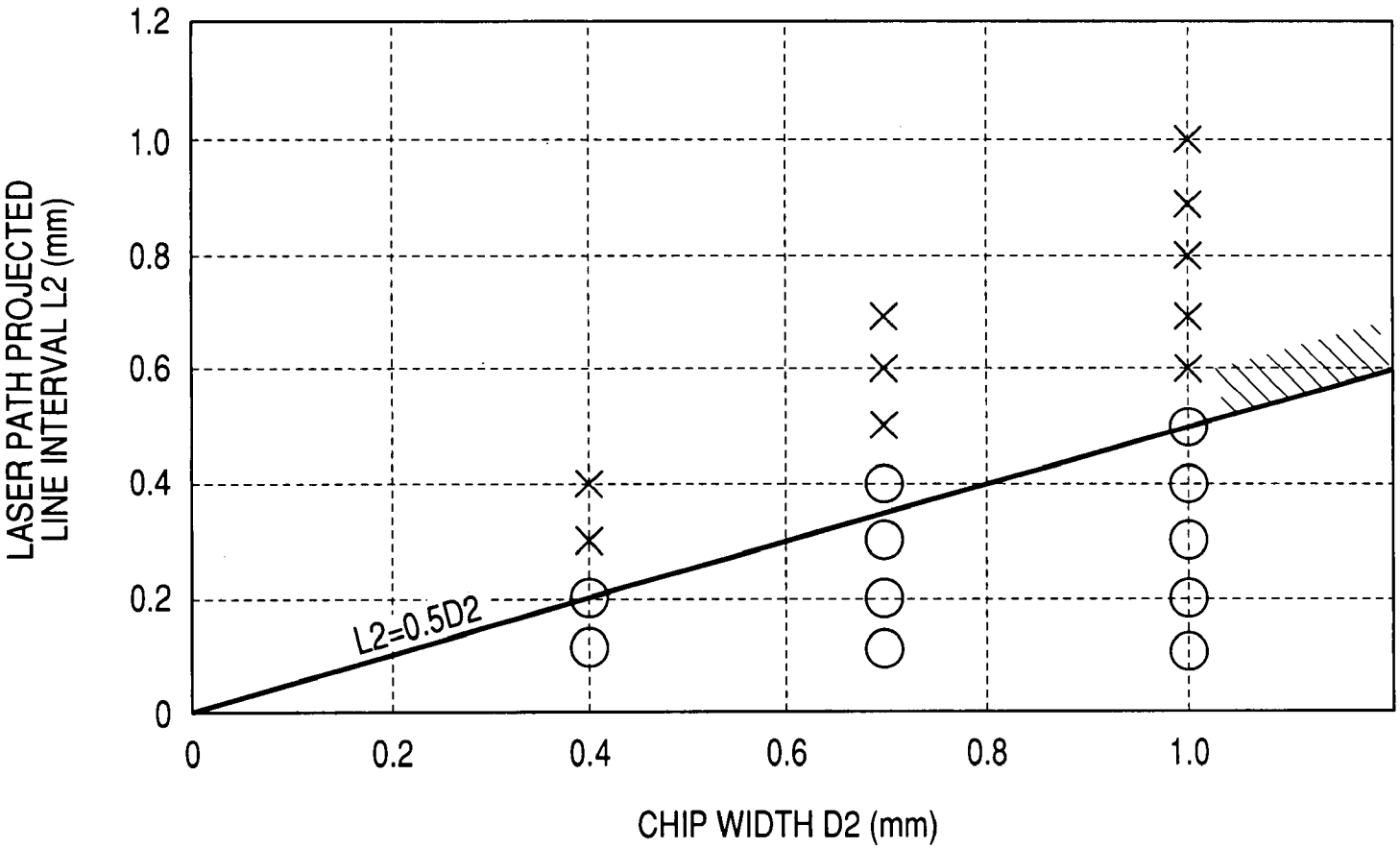
FIG. 12 is a graph which shows a relation between a laser path projected line interval and a chip width.

We researched, as shown in FIG. 12, the relation between the width D2 of the noble metal chip 45 and the interval L2 between one of the laser path projected lines LZa and LZb closer to the base 42 of the ground electrode 40 and a line extending through the center O in parallel to the one of the laser path projected lines LZa and LZb. Each plotted "○" indicates a spark plug sample in which the above described weld dimple was not produced in the fused portion 44, thus establishing the desired weld between the noble metal chip 45 and the ground electrode 40. Each plotted "×" indicates a spark plug sample in which the weld dimple was produced in the fused portion. A solid line indicates when the interval L2 is half the width W2.

Figure 13A:
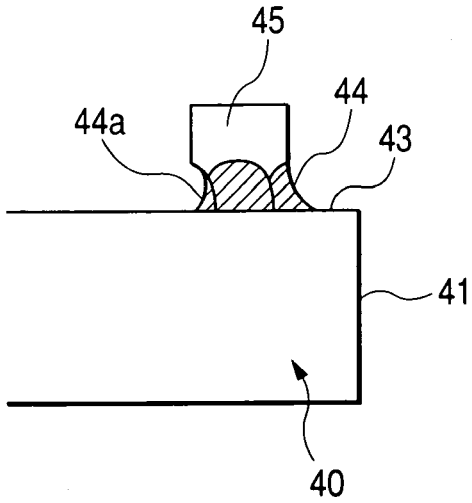
FIG. 13(*a*) is a partially sectional view which shows a dimple formed in a weld between a noble metal chip and a ground electrode.
Figure 13B:
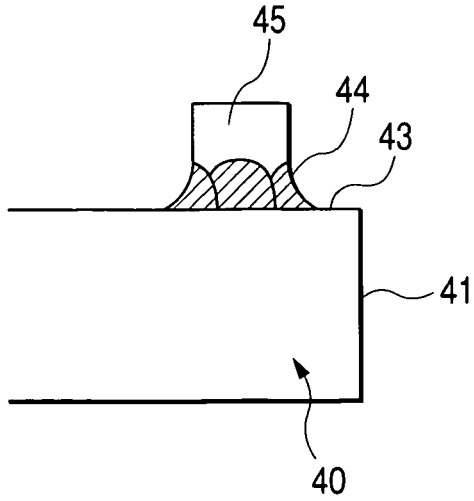
Figure 14A:
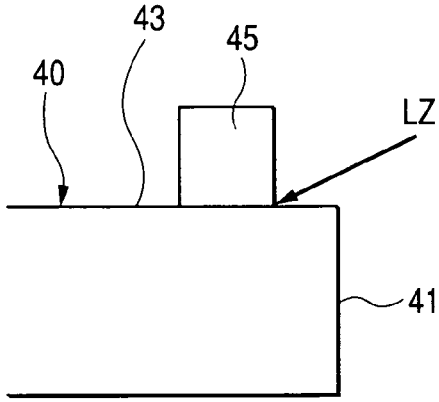
FIG. 14(*a*) is a side view which shows a noble metal chip to be welded to a ground electrode by laser beams in the first modification of the second embodiment.
Figure 14C:
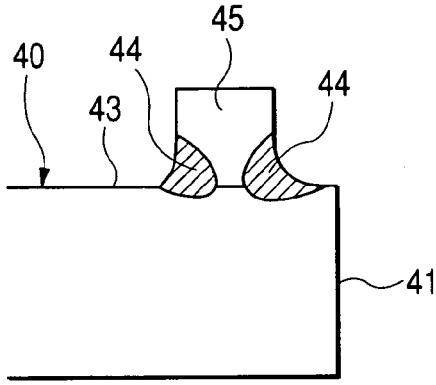
Figure 14B:
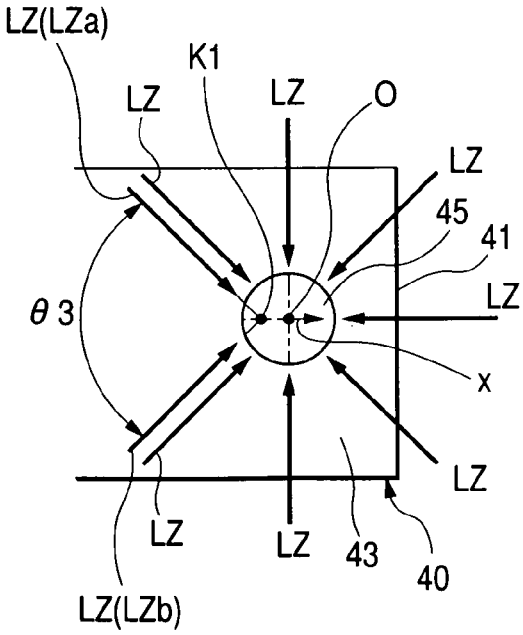
Figure 14D:
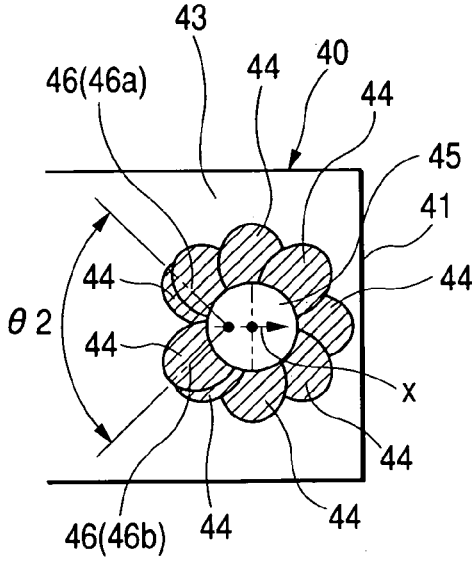
Figure 15A:
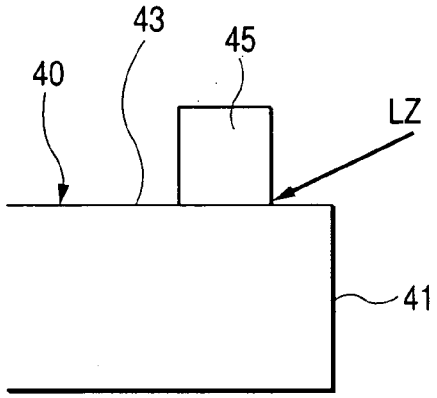
FIG. 15(*a*) is a side view which shows a noble metal chip to be welded to a ground electrode by laser beams in the second modification of the second embodiment.
Figure 15C:
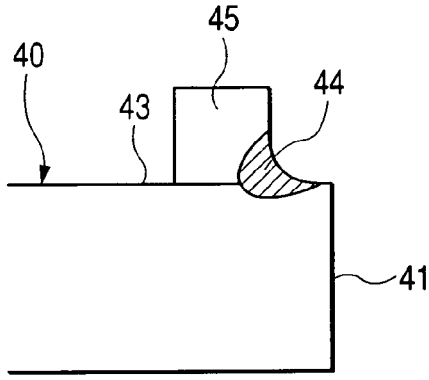
Figure 15B:
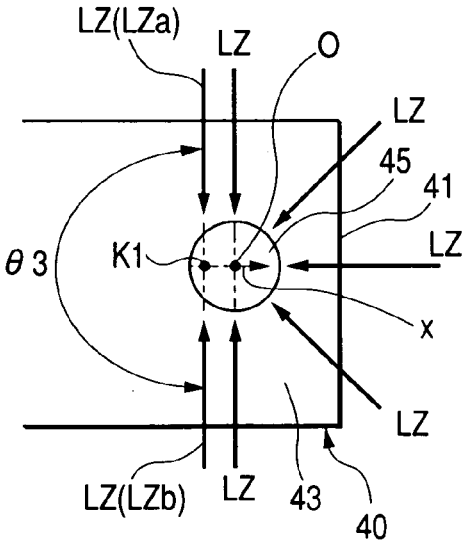
Figure 15D:
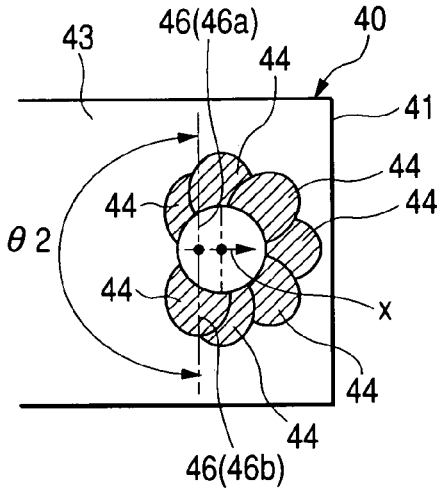
Figure 16A:
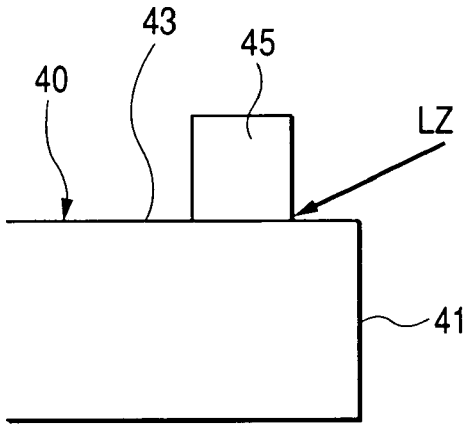
FIG. 16(*a*) is a side view which shows a noble metal chip to be welded to a ground electrode by laser beams in a modified form of the second embodiment FIG. 16(*b*) is a plan view of FIG. 16(*a*)
Figure 16C:
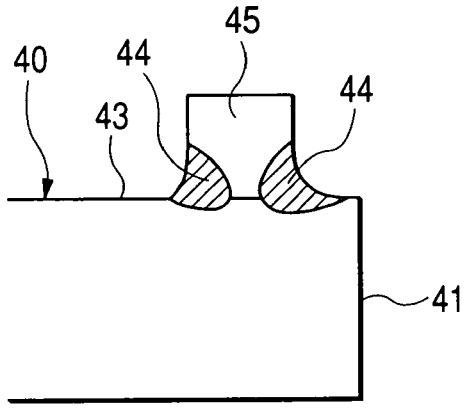
Figure 16B:
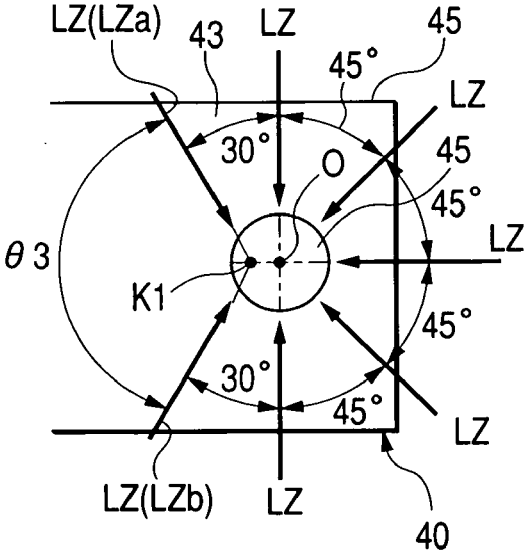
Figure 16D:
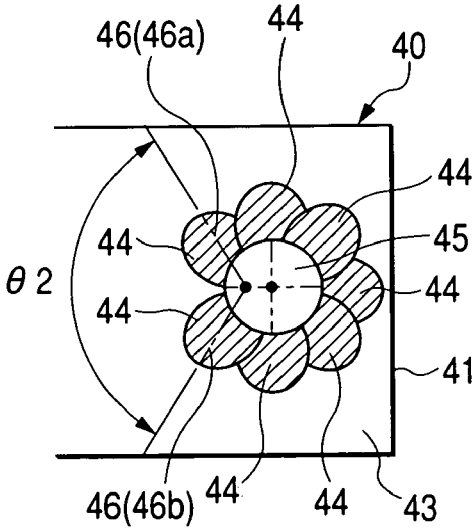
Figure 17A:
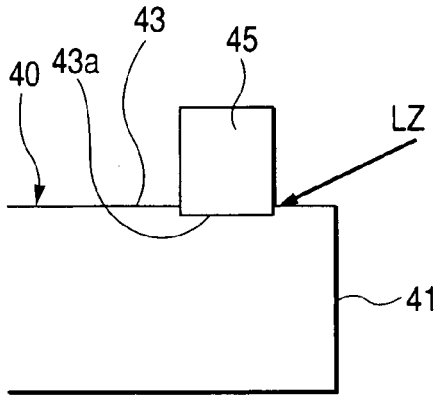
FIG. 17(*a*) is a side view which shows a noble metal chip to be welded to a ground electrode by laser beams in a modified form of the first embodiment.
Figure 17C:
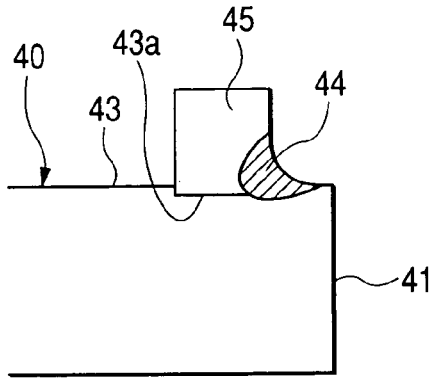
Figure 17B:
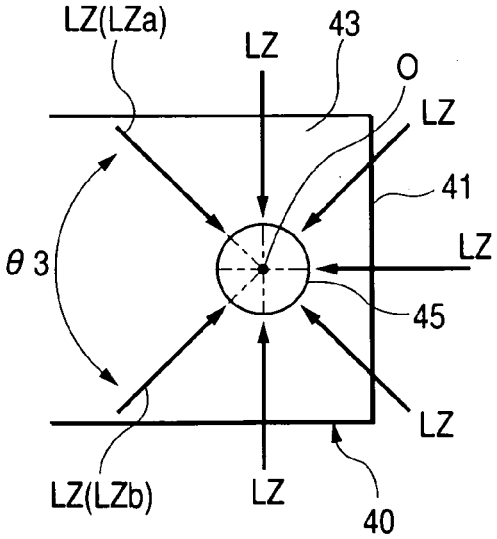
Figure 17D:
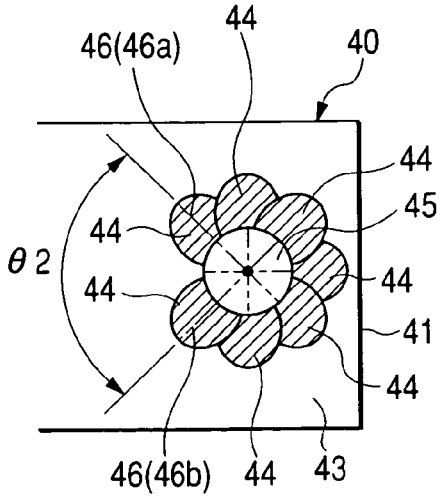
Figure 18A:
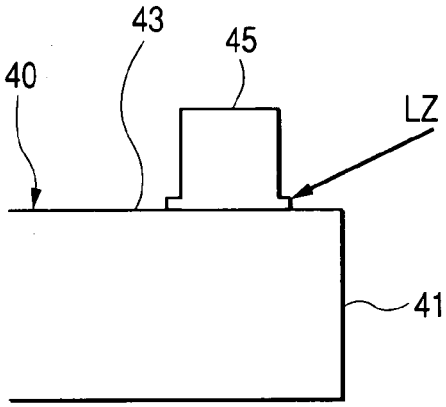
FIG. 18(*a*) is a side view which shows a noble metal chip to be welded to a ground electrode by laser beams in a modified form of the first embodiment.
Figure 18C:
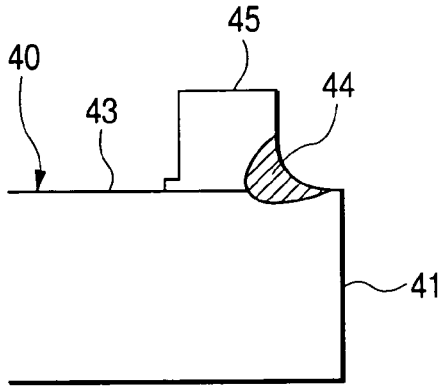
Figure 18B:
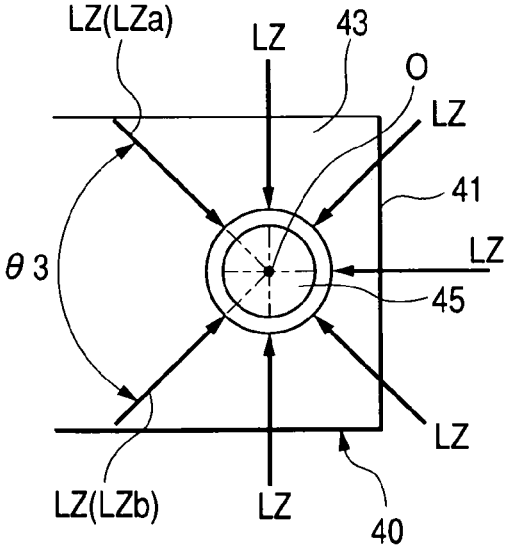
Figure 18D:
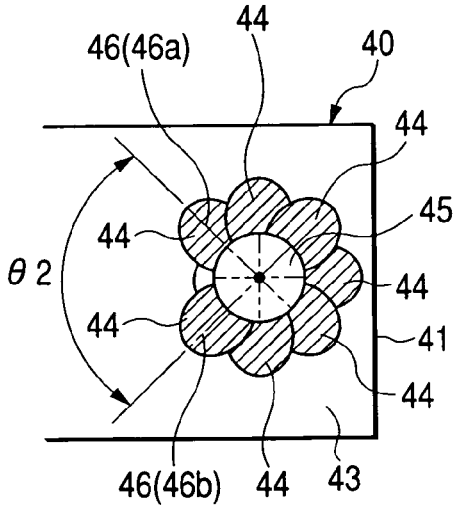
Figure 19A:
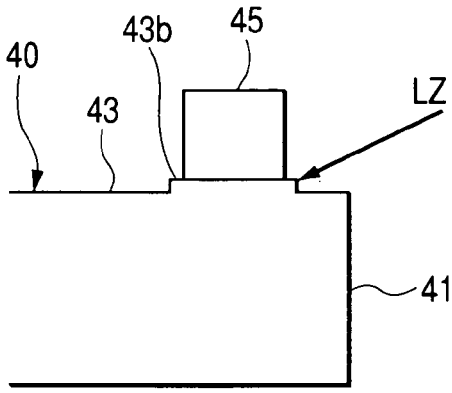
FIG. 19(*a*) is a side view which shows a noble metal chip to be welded to a ground electrode by laser beams in a modified form of the first embodiment.
Figure 19C:
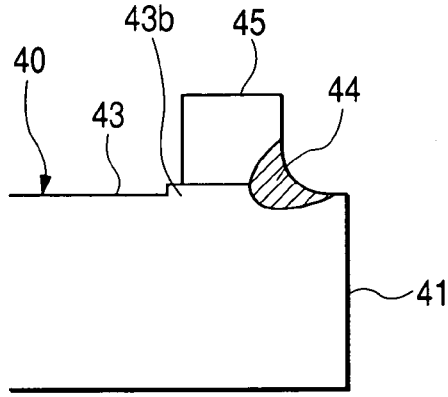
Figure 19B:
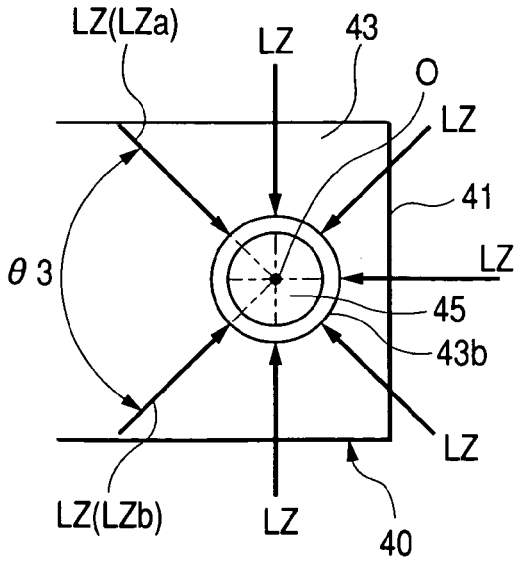
Figure 19D:
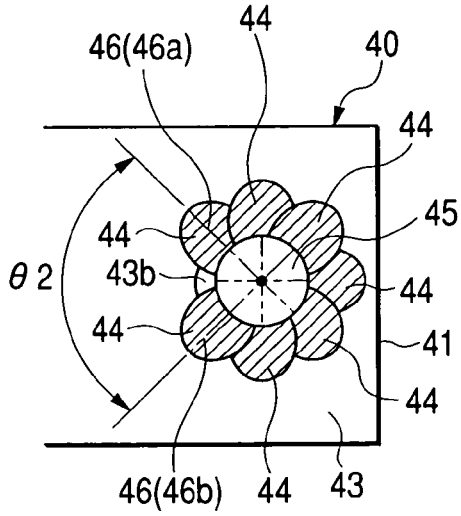
Figure 20A:
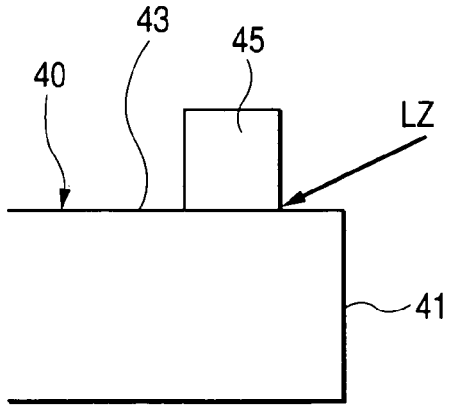
FIG. 20(*a*) is a side view which shows a noble metal chip to be welded to a ground electrode by laser beams in a modified form of the first embodiment.
Figure 20C:
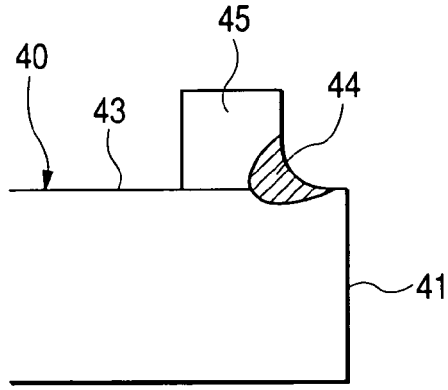
Figure 20B:
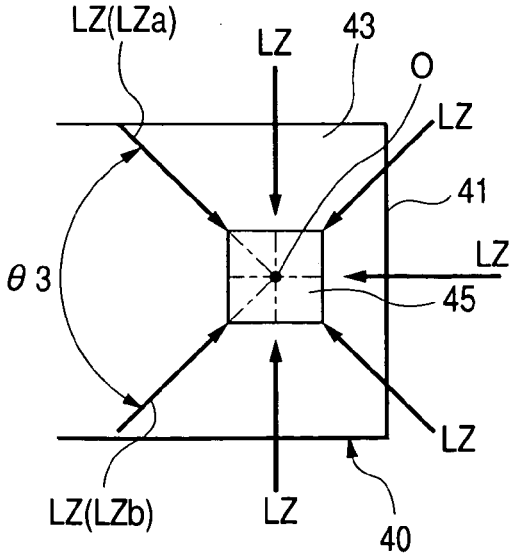
Figure 20D:
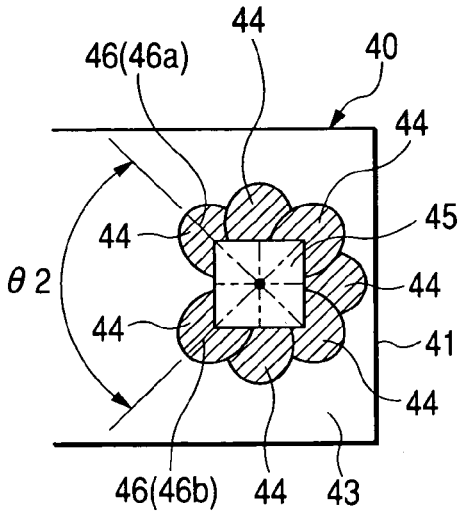

An example of the weld dimple is illustrated at 44*a* in FIG. 13(*a*). FIG. 13(*b*) shows the fused portions 44 having no weld dimple. The formation of the weld dimple 44*a* results in a decrease in the strength of the joint between the noble metal chip 45 and the ground electrode 40 as well as a reduction in quality of appearance thereof.

The graph of FIG. 12 shows that when the interval L2 is greater than 0.5 times the width D2 of the noble metal chip 45, it results in an increased possibility that the weld dimple 44*a* will be formed in the fused portion 44. It is, thus, found that when the interval L2 is less than or equal to 0.5 times the width D2 of the noble metal chip 45 (i.e., L2≦0.5D2), it avoids the formation of the weld dimple 44*a*, thus ensuring the reliability of the joint between the noble metal chip 45 and the ground electrode 40 and the quality of appearance thereof.

Note that the laser radiation paths LZ substantially coincide with the weld nugget center lines 46, therefore, it is advisable that a relation between the interval L1 between one of the weld nugget center lines 46*a* and 46*b*, as illustrated in FIG. 11(*b*), closer to the base 42 of the ground electrode 40 and a line extending through the center O in parallel to the one of the weld nugget center lines 46*a* and 46*b* and the width D1 of the noble metal chip 45 be the same as that between the interval L2 and the width D2.

As apparent from the above discussion, it is the feature of the second embodiment that the orientation of at least one of the laser path projected lines LZa and LZb located adjacent to each other across the angle θ1 is shifted from the center O of the noble metal chip 45 toward the base 42 of the ground electrode 40.

It is preferable in the second embodiment that the noble metal chip 35 of the center electrode 30 be made of an Ir alloy containing 50 wt % of Ir, the chip 45 of the ground electrode 40 be made of a Pt alloy containing 50 wt % of Pt, the noble metal chip 35 have a transverse sectional area A1 of 0.1 $mm^2$ to 1.15 $mm^2$, and the chip 45 of the ground electrode 40 have a transverse sectional area A2 of 0.1 $mm^2$ to 1.15 $mm^2$.

It is also preferable that each of the chips 35 and 45 contain, as an additive, at least one of Ir (iridium), Pt (platinum), Rh (rhodium), Ni (nickel), W (tungsten), Pd (palladium), Ru (ruthenium), Os (osmium), Al (aluminum), Y (yttrium), and $Y_2O_3$ (diyttrium trioxide or yttria).

FIGS. 14(*a*) to 14(*d*) show the first modification of the second embodiment. FIGS. 15(*a*) to 15(*d*) show the second modification of the second embodiment.

In each of the first and second modifications, intersections of the laser path projected lines LZa and LZb located adjacent to each other across the angle θ1 with the line x extending through the center O in parallel to the longitudinal center line of the ground electrode 40 between the base 42 and the tip 41 are, as can be seen from FIGS. 14(*b*) and 15(*b*), defined closer to the base 42 than the center O. This causes both intersections of the weld nugget center lines 46*a* and 46*b* located adjacent to each other across the angle θ1 with the line x to lie, as can be seen from FIGS. 14(*d*) and 15(*d*), closer to the base 42 of the ground electrode 40 than the center O.

In each of the first and second modifications as illustrated, the laser path projected lines LZa and LZb (the weld nugget center lines 46*a* and 46*b*) intersect with the line x at the same point K1, but however, they may alternatively intersect with the line x at different locations.

In the second modifications, as illustrated in FIGS. 15(*a*) to 15(*d*), the angle θ3 which the laser path projected lines LZa and LZb located adjacent to each other across the angle θ1 make with each other and the angle θ2 which the weld nugget center lines 46*a* and 46*b* located adjacent to each other across the angle θ1 make with each other are 180°, but they may be any other angle.

Modifications of either of the first and second embodiments will be described below with reference to FIGS. 16(*a*) to 20(*d*).

FIGS. 16(*a*) to 16(*d*) show the modification of the second embodiment.

The angular intervals between the laser path projected lines LZ are not uniform. In the example as illustrated, the angular interval between each of the laser path projected lines LZa and LZb located adjacent to each other across the angle θ3 and an adjacent one of the laser path projected lines LZ is 30°. Other angular intervals are 45°. The layout of the weld nugget axes 46 is illustrated in FIG. 16(*d*).

FIGS. 17(*a*) to 17(*d*) shows the modification of the first embodiment.

The ground electrode 40 has formed in the inner side surface 43 an annular recess 43*a* in which the noble metal chip 45 is to be fitted. After the noble metal chip 45 is installed in the recess 43*a*, the laser beams LZ are emitted to weld the noble metal chip 45 and the ground electrode 40 together.

The noble metal chip 45, as referred to in the above embodiments, is made of a cylindrical member which is uniform in diameter, but it may have a varying diameter or may be made up of different diameter portions with a shoulder(s), as illustrated in FIGS. 18(*a*) to 18(*d*).

In FIGS. 18(*a*) to 18(*d*), the noble metal chip 45 is of a rivet-shape. Specifically, the noble metal chip 45 has a large-diameter bottom (i.e., a flange) which is placed in abutment with the inner side surface 43 of the ground electrode 40, after which the laser beams LZ are emitted around an interface of the large-diameter bottom with the inner side surface 43.

The ground electrode 40, as illustrated in FIGS. 19(*a*) to 19(*d*), may have formed on the inner side surface 43 an annular boss 43*b* on which the noble metal chip 45 is to be placed.

The noble metal chip 45, as apparent from the above discussion, has a circular cross section, but may alternatively have any other shape in cross section such as square, triangle, or oval. FIGS. 20(*a*) to 20(*d*) show the noble metal chip 45 made of a square pole.

The number of the laser beams LZ used to joint the noble metal chip 45 to the ground electrode 40, the angle between the laser beams LZ and the inner side surface 43 of the noble metal chip 45, and the orientation of the laser beams LZ to the noble metal chip 45 may be changed depending upon the size and/or shape of the noble metal chip 45.

In the laser-welding as referred to above, the radiation angles θL, as illustrated in FIG. 3(*a*), which the paths along which the laser beams LZ travel makes with the inner side surface 43 of the ground electrode 40 are uniform, but they may be different from each other. For example, the radiation angles θL may be changed as a function of orientation of the laser beams LZ to be emitted.

Figure 21:
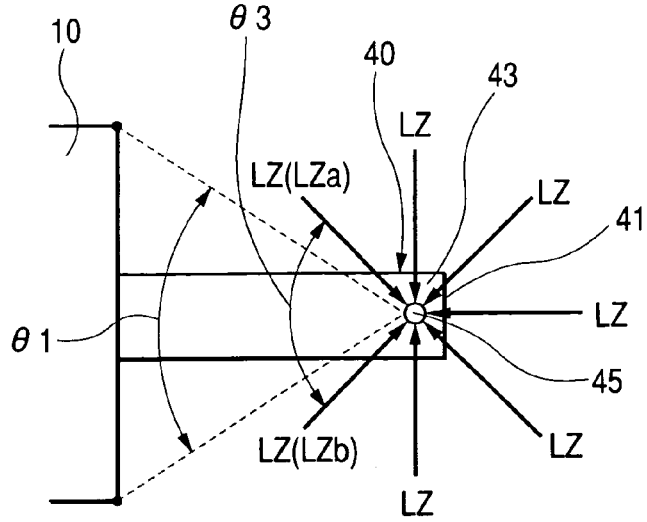
FIG. 21 is a top view which shows a modified form of laser welding.

In the above embodiments, after the porcelain insulator 20 to which the center electrode 30 is joined is installed in the metal shell 10 to which the ground electrode 40 is welded, the noble metal chip 45 is laser-welded to the ground electrode 40, but it may alternatively be done, as illustrated in FIG. 21, before the metal shell 10 and the porcelain insulator 20 are assembled. Specifically, the ground electrode 40 is welded to the metal shell 10, after which the noble metal chip 45 is welded to the ground electrode 40. Subsequently, the porcelain insulator 20 in which the center electrode 30 is already installed is fitted within the metal shell 10.

Figure 22A:
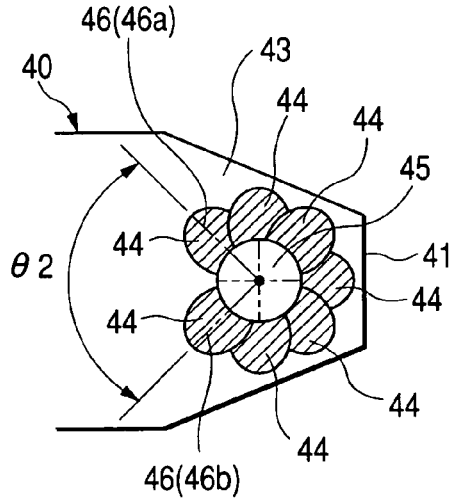
FIG. 22(*a*) is a top view which shows a modified form of a spark plug of the first embodiment.
Figure 22B:
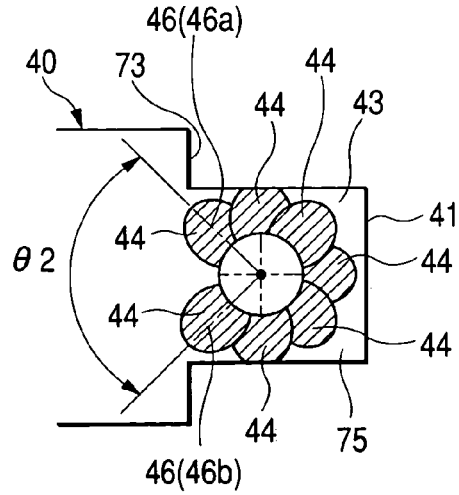

FIGS. 22(*a*) and 22(*b*) show modified forms of the ground electrode 40 which are so shaped as to decrease a thermal stress on the interface between the noble metal chip 45 and the ground electrode 40.

In the form of FIG. 22(*a*), the ground electrode 40 tapers toward the tip 41 thereof. In other words, the ground electrode 40 has the width decreasing gradually to the tip 41 thereof. In the form of FIG. 22(*b*), the ground electrode 40 has a shoulder 73 to form a smaller-width head portion 75 on which the noble metal chip 45 is welded. Such geometries serve to decrease the thermal stress acting on the ground electrode 40, thus minimizing resultant damage to the weld between the noble metal chip 45 and the ground electrode 40.

Figure 23:
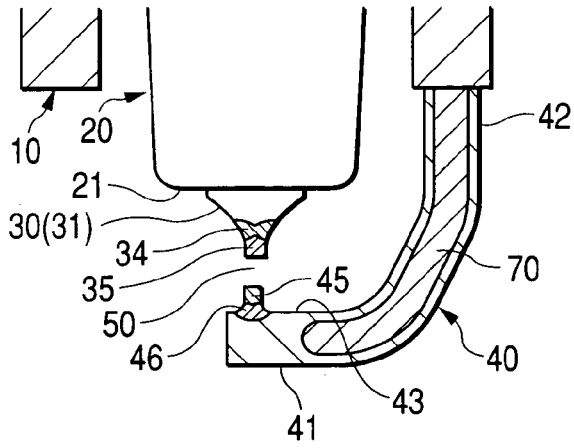
FIG. 23 is a partially sectional view which shows a modification of an internal structure of a ground electrode.
Figure 24:
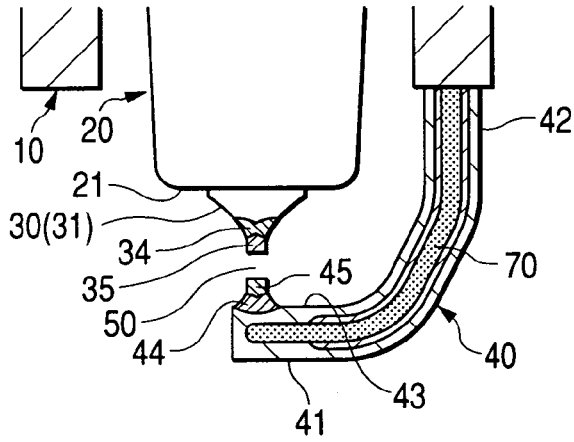
FIG. 24 is a partially sectional view which shows another modification of an internal structure of a ground electrode.

FIGS. 23 and 24 show modified forms of the ground electrode 40 which have an internal structure suitable for decreasing the thermal stress on the interface between the noble metal chip 45 and the ground electrode 40. Specifically, the ground electrode 40 in each of FIGS. 23 and 24 has a core member 70 which is greater in thermal conductivity than the base material (e.g., Ni alloy) thereof, thereby enhancing a decrease in temperature of the interface between the noble metal chip 45 and the ground electrode 40.

The core member 70 of FIG. 23 is formed by a single layer made of Cu. The core member 70 of FIG. 34 is formed by a laminate of a Cu-layer and a Ni-layer (e.g., a Ni-clad).

Figure 25:
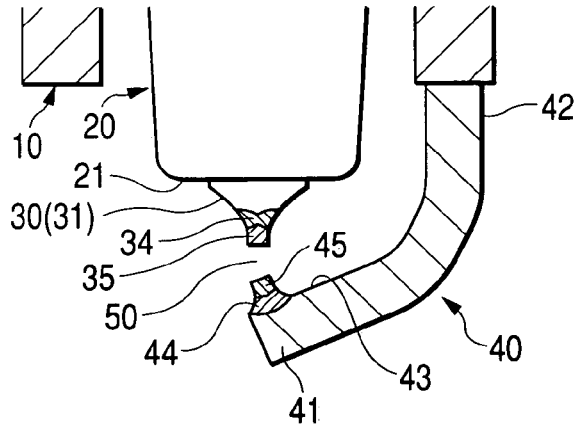
FIG. 25 is a partial side view which shows another modification of a ground electrode.

FIG. 25 shows a modified form of the ground electrode 40 which is bent at a slant to the longitudinal center line C of the spark plug 100 (see FIG. 1). This layout allows the ground electrode 40 to be decreased in length thereof, thereby reducing a rise in temperature of the ground electrode 40, thus decreasing the thermal stress on the interface between the noble metal chip 45 and the ground electrode 40.

Figure 26A:
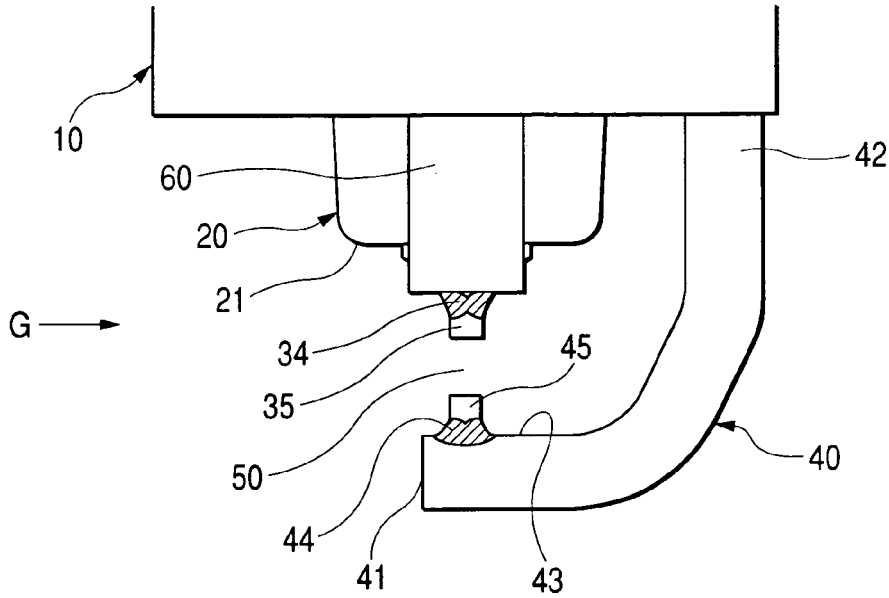
FIG. 26(*a*) is a partially side illustration which shows a modification of a spark plug with additional ground electrodes.
Figure 26B:
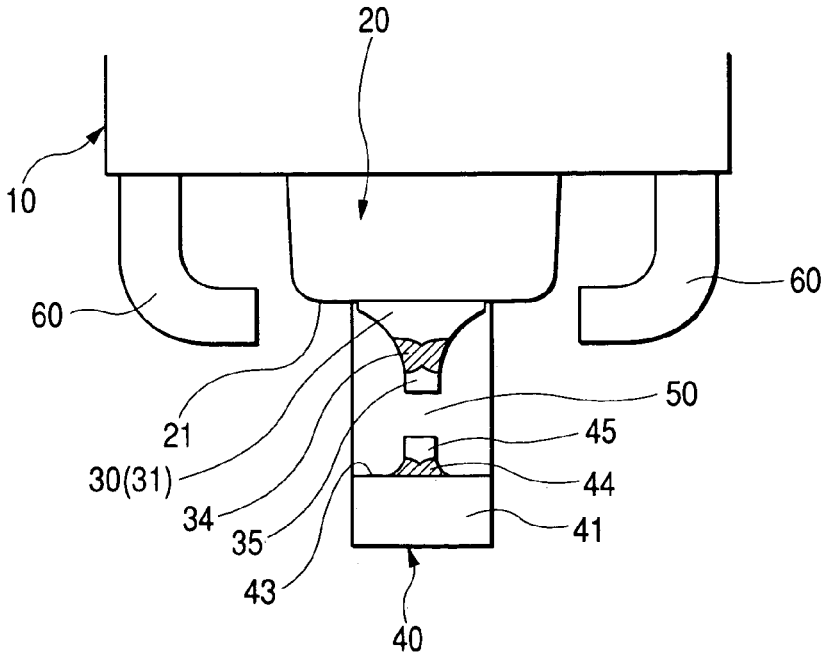
Figure 27:
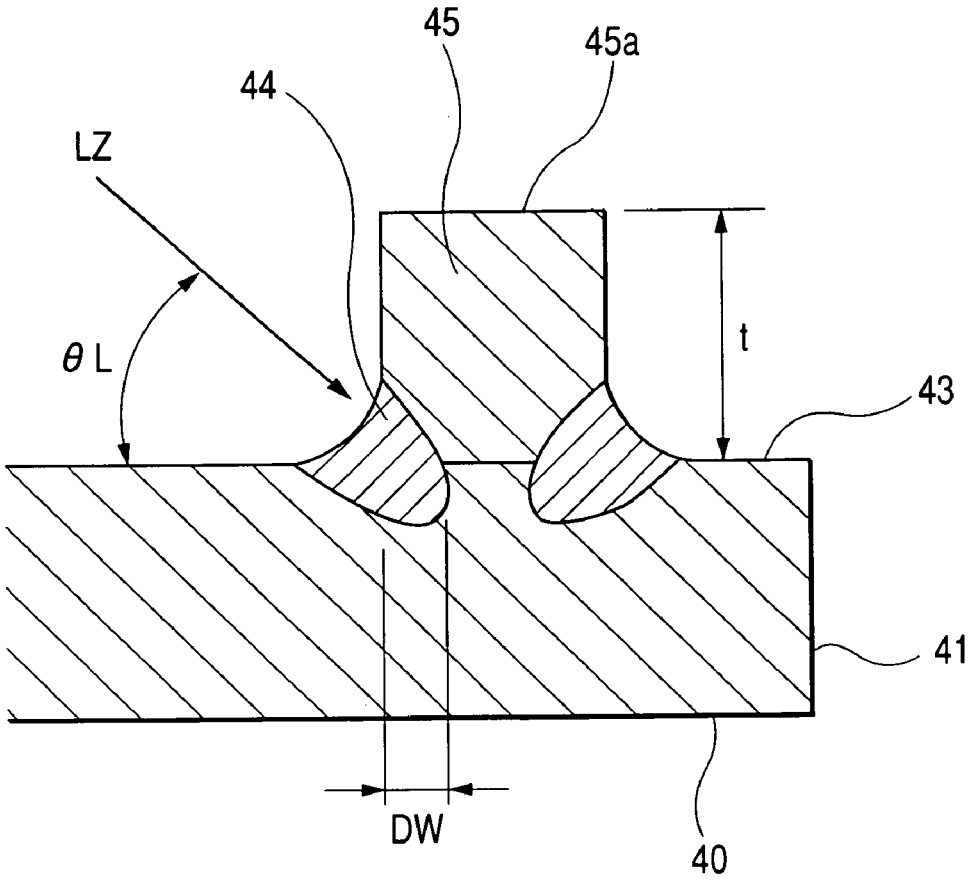
FIG. 27 (PRIOR ART)
FIG. 27 is a partially longitudinal sectional view which shows a weld between a noble metal chip and a ground electrode created by conventional laser welding.

FIGS. 26(*a*) and 26(*b*) show a modified form of the spark plug 100 which also includes additional sub-electrodes 60 welded to the metal shell 10. The sub-electrodes 60 are, as clearly shown in FIG. 26(*b*), opposed diametrically to each other across the tip 21 of the porcelain insulator 20 and work to burn out carbon adhered to the surface of the porcelain insulator 20 arising from smoldering of the spark plug 100. The user of the sub-electrodes 60, thus, results in an improved resistance to the smoldering of the spark plug 100.

While the present invention has been disclosed in terms of the preferred embodiments in order to facilitate better understanding thereof, it should be appreciated that the invention can be embodied in various ways without departing from the principle of the invention. Therefore, the invention should be understood to include all possible embodiments and modifications to the shown embodiments which can be embodied without departing from the principle of the invention as set forth in the appended claims.

What is claimed is:

1. A spark plug comprising:

a metal shell;

a center electrode disposed within said metal shell with a top portion thereof projecting from said metal shell, said center electrode having a noble metal chip laser-welded to the top portion;

a ground electrode having a first end portion, a second end portion, and a middle portion between the first and second end portions, the first end portion being welded to said metal shell, the second end portion having a center electrode-opposed surface on which a noble metal chip is laser-welded, the middle portion being bent to have the noble metal chip face the noble metal chip of said center electrode through a spark gap; and fused portions formed around an interface between the noble metal chip and the center electrode-opposed surface of said ground electrode, said fused portions creating welds between the noble metal chip and said ground electrode and being formed by materials of said ground electrode and said noble metal chip melted together by emitting laser beams around the interface between the noble metal chip and the center electrode-opposed surface of said ground electrode, wherein the noble metal chip of said ground electrode has a given length and projects toward said center electrode from the center electrode-opposed surface by 0.3 mm or more in a longitudinal direction thereof, wherein fused portion sectional area centerlines, each defined as a line extending inward of the noble metal chip of said ground electrode through a center of a sectional area of a respective said fused portion, at the interface between the noble metal chip and the center electrode-opposed surface of said ground electrode, lie outside an angle θ1, angle θ1 being defined as the angle between lines extending from the noble metal chip on the ground electrode, before it is bent, in a plane of the center electrode-opposed surface of said around electrode to respective edges of said metal shell opposed in a widthwise direction of said metal shell, and wherein a transverse sectional area A of a portion of the noble metal chip of said ground electrode closest to said fused portions, as taken perpendicular to the length of the noble metal chip of the ground electrode, and a transverse sectional area B of an unfused portion of the noble metal chip of said ground electrode, as taken over the interface between the noble metal chip and the center electrode-opposed surface of said ground electrode, have values such that an unfused portion sectional area percentage, defined as a percentage of the sectional area B in the sectional area A is 50 or less.

2. A spark plug as set forth in claim 1, wherein an angle θ2, which two of the fused portion sectional area center lines located adjacent to each other across the angle θ1 make with each others is greater than the angle θ1.

3. A spark plug as set forth in claim 1, wherein an intersection of a line x extending through a center O of a transverse sectional area of the noble metal chip of said ground electrode in parallel to a longitudinal center line of said ground electrode with at least one of two of the fused portion sectional area center lines located adjacent to each other across the angle θ1 is located closer to the first end portion of said ground electrode than the center O of the transverse sectional area.

4. A spark plug as set forth in claim 3, wherein an interval L1 between one of the two fused portion sectional area center lines located adjacent to each other across the angle θ1 which is located closer to the first end portion of said ground electrode than the center O of the transverse sectional area and a line extending parallel to the one of the two fused portion sectional area center lines through the center O of the transverse sectional area is 0.5 times a width D1 or less, where D1 is a greater of widths of the noble metal chip of said ground electrode in directions perpendicular to the two of the fused portion sectional area center lines located adjacent to each other across the angle θ1.

5. A spark plug as set forth in claim 1, wherein the noble metal chip of said center electrode is made of an Ir alloy containing 50 Wt % or more of Ir, the noble metal chip of said ground electrode being made of a Pt alloy containing 50 Wt % of Pt, and wherein a transverse sectional area A1 of the noble metal chip of said center electrode, as taken in a direction perpendicular to the length thereof, and a transverse sectional area A2 of the noble metal chip of said ground electrode, as taken in a direction perpendicular to the length thereof, are each between 0.1 $mm^2$ and 1.15 $mm^2$.

6. A spark plug as set forth in claim 5, wherein each of the noble metal chips of said center electrode and said ground electrode is made of a material containing, as an additive, one of Ir, Pt, Rh, Ni, W, Pd, Ru, Os, Al, Y, and $Y_2O_3$.

7. A spark plug as set forth in claim 1, wherein the unfused portion sectional area percentage is 30% or less.

* * * * *